US009729989B2

(12) United States Patent
Marten

(10) Patent No.: US 9,729,989 B2
(45) Date of Patent: Aug. 8, 2017

(54) HOME AUTOMATION SOUND DETECTION AND POSITIONING

(71) Applicant: Echostar Technologies L.L.C., Englewood, CO (US)

(72) Inventor: Neil Marten, Lakewood, CO (US)

(73) Assignee: ECHOSTAR TECHNOLOGIES L.L.C., Englewood, CO (US)

( * ) Notice: Subject to any disclaimer, the term of this patent is extended or adjusted under 35 U.S.C. 154(b) by 84 days.

(21) Appl. No.: 14/671,299

(22) Filed: Mar. 27, 2015

(65) Prior Publication Data

US 2016/0286327 A1 Sep. 29, 2016

(51) Int. Cl.

| | |
|---|---|
| ***H04R 29/00*** | (2006.01) |
| ***G08B 13/16*** | (2006.01) |
| *G08B 19/00* | (2006.01) |

(52) U.S. Cl.

CPC ..... *H04R 29/008* (2013.01); *G08B 13/1672* (2013.01); *G08B 19/00* (2013.01)

(58) Field of Classification Search

CPC .... H04R 29/00; H04R 29/004; H04R 29/005; H04R 29/008; H04R 2499/00; H04R 2499/01; H04R 2499/15

USPC ..... 381/56, 58, 124

See application file for complete search history.

(56) References Cited

U.S. PATENT DOCUMENTS

| | | | |
|---|---|---|---|
| 4,386,436 | A | 5/1983 | Kocher et al. |
| 4,581,606 | A | 4/1986 | Mallory |
| 4,728,949 | A | 3/1988 | Platte et al. |
| 4,959,713 | A | 9/1990 | Morotomi et al. |
| 5,400,246 | A | 3/1995 | Wilson et al. |
| 5,770,896 | A | 6/1998 | Nakajima |

(Continued)

FOREIGN PATENT DOCUMENTS

| | | | |
|---|---|---|---|
| CA | 2 267 988 | A1 | 4/1998 |
| CN | 105814555 | A | 7/2016 |

(Continued)

OTHER PUBLICATIONS

U.S. Appl. No. 14/485,188, filed Sep. 12, 2014, Pre-Interview First Office Action mailed Jul. 29, 2015, 20 pages.

(Continued)

*Primary Examiner* — William A Jerez Lora

(74) *Attorney, Agent, or Firm* — Kilpatrick Townsend & Stockton LLP

(57) ABSTRACT

Systems, methods, devices, non-transitory computer-readable mediums, and apparatuses are presented for detecting and positioning sound in a home automation system. Indications of sounds and timestamps may be received from various home automation devices. Using the received indications, a sound magnitude for the sound and whether the sound originated inside or outside of the structure can be determined. The sound magnitude may be compared to an inside sound threshold level if the sound was determined to originate inside the structure or compared to an outside sound threshold level if the sound was determined to originate outside the structure. Sound information corresponding to the sound may be logged if the sound was determined to originate inside and the sound magnitude exceeds the inside sound threshold level or the sound was determined to originate outside and the sound magnitude exceeds the outside sound threshold level.

20 Claims, 9 Drawing Sheets

(56) References Cited

U.S. PATENT DOCUMENTS 5,805,442 A 9/1998 Crater et al.
5,822,012 A 10/1998 Jeon et al.
5,894,331 A 4/1999 Yang
5,926,090 A 7/1999 Taylor et al.
5,970,030 A 10/1999 Dimitri et al.
6,081,758 A 6/2000 Parvulescu
6,104,334 A 8/2000 Allport
6,107,918 A * 8/2000 Klein ..... G08B 25/14 340/3.1
6,107,935 A 8/2000 Comerford et al.
6,119,088 A 9/2000 Ciluffo
6,182,094 B1 1/2001 Humpleman et al.
6,286,764 B1 9/2001 Garvey et al.
6,330,621 B1 12/2001 Bakke et al.
6,337,899 B1 1/2002 Alcendor et al.
6,377,858 B1 4/2002 Koeppe
6,405,284 B1 6/2002 Bridge
6,415,257 B1 7/2002 Jungua et al.
6,502,166 B1 12/2002 Cassidy
6,529,230 B1 3/2003 Chong
6,553,375 B1 4/2003 Huang et al.
6,646,676 B1 11/2003 DaGraca et al.
6,662,282 B2 12/2003 Cochran
6,744,771 B1 6/2004 Barber et al.
6,748,343 B2 6/2004 Alexander et al.
6,751,657 B1 6/2004 Zothner
6,756,998 B1 6/2004 Bilger
6,931,104 B1 8/2005 Foster et al.
6,976,187 B2 12/2005 Arnott et al.
6,989,731 B1 1/2006 Kawai et al.
7,009,528 B2 3/2006 Griep
7,010,332 B1 3/2006 Irvin et al.
7,088,238 B2 8/2006 Karaoguz et al.
7,103,545 B2 9/2006 Furuta
7,143,298 B2 11/2006 Wells et al.
7,234,074 B2 6/2007 Cohn et al.
7,260,538 B2 8/2007 Calderone et al.
7,346,917 B2 3/2008 Gatto et al.
7,372,370 B2 5/2008 Stults et al.
7,386,666 B1 6/2008 Beauchamp et al.
7,395,369 B2 7/2008 Sepez et al.
7,395,546 B1 7/2008 Asmussen
7,529,677 B1 5/2009 Wittenberg
7,574,494 B1 8/2009 Mayernick et al.
7,590,703 B2 9/2009 Cashman et al.
7,640,351 B2 12/2009 Reckamp et al.
7,659,814 B2 * 2/2010 Chen ..... G08B 25/08 340/531
7,694,005 B2 4/2010 Reckamp et al.
7,739,718 B1 6/2010 Young et al.
7,861,034 B2 12/2010 Yamamoto et al.
7,870,232 B2 1/2011 Reckamp et al.
7,945,297 B2 5/2011 Philipp
7,969,318 B2 6/2011 White et al.
8,013,730 B2 9/2011 Oh et al.
8,086,757 B2 12/2011 Chang
8,106,768 B2 1/2012 Neumann
8,156,368 B2 4/2012 Chambliss et al.
8,171,148 B2 5/2012 Lucas et al.
8,180,735 B2 5/2012 Ansari et al.
8,201,261 B2 6/2012 Barfield et al.
8,221,290 B2 7/2012 Vincent et al.
8,275,143 B2 9/2012 Johnson
8,289,157 B2 10/2012 Patenaude et al.
8,290,545 B2 10/2012 Terlizzi
8,310,335 B2 11/2012 Sivakkolundhu
8,316,413 B2 11/2012 Crabtree
8,320,578 B2 11/2012 Kahn et al.
8,335,312 B2 12/2012 Gerhardt et al.
8,413,204 B2 4/2013 White et al.
8,498,572 B1 7/2013 Schooley et al.
8,516,087 B2 8/2013 Wilson et al.
8,539,567 B1 9/2013 Logue et al.
8,550,368 B2 10/2013 Butler et al.
8,619,136 B2 12/2013 Howarter et al.
8,620,841 B1 12/2013 Filson et al.
8,644,525 B2 2/2014 Bathurst et al.
8,645,327 B2 2/2014 Falkenburg et al.
8,667,529 B2 3/2014 Taxier
8,750,576 B2 6/2014 Huang et al.
8,780,201 B1 7/2014 Scalisi et al.
8,786,698 B2 7/2014 Chen et al.
8,799,413 B2 8/2014 Taylor et al.
8,898,709 B2 11/2014 Crabtree
8,923,823 B1 12/2014 Wilde
8,930,700 B2 1/2015 Wielopolski
8,965,170 B1 2/2015 Benea et al.
9,019,111 B1 4/2015 Sloo et al.
9,049,567 B2 6/2015 Le Guen et al.
9,191,804 B1 11/2015 Paczkowski et al.
9,246,921 B1 1/2016 Vlaminck et al.
9,258,593 B1 2/2016 Chen et al.
9,462,041 B1 10/2016 Hagins et al.
9,495,860 B2 11/2016 Lett
9,511,259 B2 12/2016 Mountain
9,599,981 B2 3/2017 Crabtree
9,621,959 B2 4/2017 Mountain
9,632,746 B2 4/2017 Keipert et al.
2001/0012998 A1 8/2001 Jouet et al.
2002/0003493 A1 1/2002 Durst et al.
2002/0019725 A1 2/2002 Petite
2002/0063633 A1 5/2002 Park
2002/0080238 A1 6/2002 Ohmura
2002/0193989 A1 12/2002 Geilhufe et al.
2003/0005431 A1 1/2003 Shinohara
2003/0052789 A1 3/2003 Colmenarez et al.
2003/0097452 A1 5/2003 Kim et al.
2003/0126593 A1 7/2003 Mault
2003/0133551 A1 7/2003 Kahn
2003/0140352 A1 7/2003 Kim
2003/0201900 A1 10/2003 Bachinski et al.
2004/0019489 A1 1/2004 Funk et al.
2004/0117038 A1 6/2004 Karaoguz et al.
2004/0117843 A1 6/2004 Karaoguz et al.
2004/0121725 A1 6/2004 Matsui
2004/0128034 A1 7/2004 Lenker et al.
2004/0143838 A1 7/2004 Rose
2004/0148419 A1 7/2004 Chen et al.
2004/0148632 A1 7/2004 Park et al.
2004/0260407 A1 12/2004 Wimsatt
2004/0266419 A1 12/2004 Arling et al.
2005/0038875 A1 2/2005 Park
2005/0049862 A1 3/2005 Choi et al.
2005/0106267 A1 5/2005 Frykman et al.
2005/0188315 A1 8/2005 Campbell et al.
2005/0200478 A1 9/2005 Koch et al.
2005/0245292 A1 11/2005 Bennett et al.
2005/0264698 A1 12/2005 Eshleman
2005/0289614 A1 12/2005 Baek et al.
2006/0011145 A1 1/2006 Kates
2006/0087428 A1 4/2006 Wolfe et al.
2006/0136968 A1 6/2006 Han et al.
2006/0143679 A1 6/2006 Yamada et al.
2006/0155389 A1 7/2006 Pessolano et al.
2006/0253894 A1 11/2006 Bookman et al.
2007/0044119 A1 2/2007 Sullivan et al.
2007/0078910 A1 4/2007 Bopardikar
2007/0129220 A1 6/2007 Bardha
2007/0135225 A1 6/2007 Nieminen et al.
2007/0142022 A1 6/2007 Madonna et al.
2007/0146545 A1 6/2007 Iwahashi
2007/0157258 A1 7/2007 Jung et al.
2007/0192486 A1 8/2007 Wilson et al.
2007/0256085 A1 11/2007 Reckamp et al.
2007/0271518 A1 11/2007 Tischer et al.
2007/0275670 A1 * 11/2007 Chen ..... G08B 25/08 455/73
2008/0019392 A1 1/2008 Lee
2008/0021971 A1 1/2008 Halgas
2008/0022322 A1 1/2008 Grannan et al.
2008/0046930 A1 2/2008 Smith et al.
2008/0062258 A1 3/2008 Bentkovski et al.
2008/0062965 A1 3/2008 Silva et al.
2008/0109095 A1 5/2008 Braithwaite et al.

(56) References Cited

U.S. PATENT DOCUMENTS

2008/0114963 A1 5/2008 Cannon et al.
2008/0123825 A1 5/2008 Abramson et al.
2008/0140736 A1 6/2008 Jarno
2008/0144884 A1 6/2008 Habibi
2008/0163330 A1 7/2008 Sparrell
2008/0278635 A1 11/2008 Hardacker et al.
2008/0284905 A1 11/2008 Chuang
2008/0288876 A1 11/2008 Fleming
2008/0297660 A1 12/2008 Shioya
2009/0023554 A1 1/2009 Shim
2009/0069038 A1 3/2009 Olague et al.
2009/0083374 A1 3/2009 Saint Clair
2009/0112541 A1 4/2009 Anderson et al.
2009/0138507 A1 5/2009 Burckart et al.
2009/0146834 A1 6/2009 Huang
2009/0165069 A1 6/2009 Kirchner
2009/0167555 A1 7/2009 Kohanek
2009/0190040 A1 7/2009 Watanabe et al.
2009/0235992 A1 9/2009 Armstrong
2009/0249428 A1 10/2009 White et al.
2009/0271203 A1 10/2009 Resch et al.
2009/0307715 A1 12/2009 Santamaria et al.
2010/0031286 A1 2/2010 Gupta et al.
2010/0045471 A1 2/2010 Meyers
2010/0046918 A1 2/2010 Takao et al.
2010/0083371 A1 4/2010 Bennetts et al.
2010/0097225 A1 4/2010 Petricoin, Jr.
2010/0122284 A1 5/2010 Yoon et al.
2010/0131280 A1 5/2010 Bogineni
2010/0138007 A1 6/2010 Clark et al.
2010/0138858 A1 6/2010 Velazquez et al.
2010/0146445 A1 6/2010 Kraut
2010/0211546 A1 8/2010 Grohman et al.
2010/0283579 A1 11/2010 Kraus et al.
2010/0321151 A1 12/2010 Matsuura et al.
2011/0030016 A1 2/2011 Pino et al.
2011/0032423 A1 2/2011 Jing et al.
2011/0093126 A1 4/2011 Toba et al.
2011/0119325 A1 5/2011 Paul et al.
2011/0150432 A1 6/2011 Paul et al.
2011/0156862 A1 6/2011 Langer
2011/0187928 A1 8/2011 Crabtree
2011/0187930 A1 8/2011 Crabtree
2011/0187931 A1 8/2011 Kim
2011/0202956 A1 8/2011 Connelly et al.
2011/0270549 A1 11/2011 Jeansonne et al.
2011/0282837 A1 11/2011 Gounares et al.
2011/0283311 A1 11/2011 Luong
2011/0295396 A1 12/2011 Chinen et al.
2012/0019388 A1 1/2012 Kates
2012/0047532 A1 2/2012 McCarthy
2012/0059495 A1 3/2012 Weiss et al.
2012/0069246 A1 3/2012 Thornberry et al.
2012/0094696 A1 4/2012 Ahn et al.
2012/0124456 A1 5/2012 Perez et al.
2012/0154108 A1 6/2012 Sugaya
2012/0164975 A1 6/2012 Dodeja et al.
2012/0271670 A1 10/2012 Zaloom
2012/0280802 A1 11/2012 Yoshida et al.
2012/0291068 A1 11/2012 Khushoo et al.
2012/0314713 A1 12/2012 Singh et al.
2012/0316876 A1 12/2012 Jang et al.
2012/0326835 A1 12/2012 Cockrell et al.
2013/0046800 A1 2/2013 Assi et al.
2013/0049950 A1 2/2013 Wohlert
2013/0053063 A1 2/2013 McSheffrey
2013/0060358 A1 3/2013 Li et al.
2013/0070044 A1 3/2013 Naidoo et al.
2013/0074061 A1 3/2013 Averbuch et al.
2013/0090213 A1 4/2013 Amini et al.
2013/0124192 A1 5/2013 Lindmark et al.
2013/0138757 A1 5/2013 Ferron
2013/0152139 A1 6/2013 Davis et al.
2013/0185750 A1 7/2013 Ayoub
2013/0204408 A1 8/2013 Thiruvengada et al.
2013/0238326 A1 9/2013 Kim et al.
2013/0267383 A1 10/2013 Watterson
2013/0300576 A1 11/2013 Sinsuan et al.
2013/0318559 A1 11/2013 Crabtree
2013/0321637 A1 12/2013 Frank et al.
2013/0324247 A1 12/2013 Esaki et al.
2014/0028546 A1 1/2014 Jeon et al.
2014/0095684 A1 4/2014 Nonaka et al.
2014/0101465 A1 4/2014 Wang et al.
2014/0142724 A1 5/2014 Park et al.
2014/0160360 A1 6/2014 Hsu et al.
2014/0168277 A1 6/2014 Ashley et al.
2014/0192197 A1 7/2014 Hanko et al.
2014/0192997 A1* 7/2014 Niu ..... H04R 3/005 381/92
2014/0201315 A1 7/2014 Jacob et al.
2014/0215505 A1* 7/2014 Balasubramanian ..... H04N 21/4722 725/13
2014/0218517 A1 8/2014 Kim et al.
2014/0223548 A1 8/2014 Wassingbo
2014/0266669 A1 9/2014 Fadell et al.
2014/0266684 A1 9/2014 Poder et al.
2014/0282653 A1 9/2014 Ariantaj et al.
2014/0310075 A1 10/2014 Ricci
2014/0333529 A1 11/2014 Kim et al.
2014/0351832 A1 11/2014 Cho et al.
2014/0362201 A1 12/2014 Nguyen et al.
2014/0373074 A1 12/2014 Hwang et al.
2015/0029096 A1 1/2015 Ishihara
2015/0054910 A1 2/2015 Offen et al.
2015/0061859 A1 3/2015 Matsuoka et al.
2015/0066173 A1 3/2015 Ellis et al.
2015/0082225 A1 3/2015 Shearer
2015/0084770 A1 3/2015 Xiao et al.
2015/0097689 A1 4/2015 Logue et al.
2015/0100167 A1 4/2015 Sloo et al.
2015/0106866 A1 4/2015 Fujita
2015/0113571 A1 4/2015 Cholas et al.
2015/0127712 A1 5/2015 Fadell et al.
2015/0142991 A1 5/2015 Zaloom
2015/0143406 A1 5/2015 Cho et al.
2015/0143408 A1 5/2015 Sallas
2015/0145643 A1 5/2015 Fadell et al.
2015/0154850 A1 6/2015 Fadell et al.
2015/0156030 A1 6/2015 Fadell et al.
2015/0156612 A1 6/2015 Vemulapalli
2015/0159401 A1 6/2015 Patrick et al.
2015/0160623 A1 6/2015 Holley
2015/0160634 A1 6/2015 Smith et al.
2015/0160635 A1 6/2015 Schofield et al.
2015/0160636 A1 6/2015 McCarthy et al.
2015/0160663 A1 6/2015 McCarthy et al.
2015/0160935 A1 6/2015 Nye
2015/0161452 A1 6/2015 McCarthy et al.
2015/0161882 A1 6/2015 Lett
2015/0162006 A1 6/2015 Kummer
2015/0163411 A1 6/2015 McCarthy, III et al.
2015/0163412 A1 6/2015 Holley et al.
2015/0163535 A1 6/2015 McCarthy et al.
2015/0172742 A1 6/2015 Richardson
2015/0192914 A1 7/2015 Slupik
2015/0198941 A1 7/2015 Pederson
2015/0241860 A1 8/2015 Raid
2015/0281824 A1 10/2015 Nguyen et al.
2015/0309487 A1 10/2015 Lyman
2015/0341599 A1 11/2015 Carey
2015/0347910 A1 12/2015 Fadell et al.
2015/0365787 A1 12/2015 Farrell
2016/0063854 A1 3/2016 Burton et al.
2016/0066046 A1 3/2016 Mountain
2016/0091471 A1 3/2016 Benn
2016/0100696 A1 4/2016 Palashewski et al.
2016/0109864 A1 4/2016 Lonn
2016/0121161 A1 5/2016 Mountain
2016/0123741 A1 5/2016 Mountain
2016/0163168 A1* 6/2016 Brav ..... G08B 13/1672 381/56
2016/0182249 A1 6/2016 Lea

(56) References Cited

U.S. PATENT DOCUMENTS

| | | | |
|---|---|---|---|
| 2016/0191912 | A1 | 6/2016 | Lea et al. |
| 2016/0191990 | A1 | 6/2016 | McCarthy |
| 2016/0203700 | A1 | 7/2016 | Bruhn et al. |
| 2016/0234034 | A1 | 8/2016 | Mahar et al. |
| 2016/0256485 | A1 | 9/2016 | Wager et al. |
| 2016/0260135 | A1 | 9/2016 | Zomet et al. |
| 2016/0323548 | A1 | 11/2016 | Khot et al. |
| 2016/0334811 | A1 | 11/2016 | Marten |
| 2016/0335423 | A1 | 11/2016 | Beals |
| 2016/0342379 | A1 | 11/2016 | Keipert et al. |
| 2017/0054615 | A1 | 2/2017 | Wilson |

FOREIGN PATENT DOCUMENTS

| | | | |
|---|---|---|---|
| EP | 2 736 027 | A1 | 5/2014 |
| EP | 3 080 677 | A1 | 10/2016 |
| EP | 3 080 710 | A1 | 10/2016 |
| GB | 2 304 952 | A | 3/1997 |
| JP | 2008148016 | A | 6/2008 |
| WO | 93/20544 | A1 | 10/1993 |
| WO | 2004/068386 | A1 | 8/2004 |
| WO | 2011/095567 | A1 | 8/2011 |
| WO | 2014/068556 | A1 | 5/2014 |
| WO | 2015/179120 | A1 | 11/2015 |
| WO | 2016/034880 | A1 | 3/2016 |
| WO | 2016/066399 | A1 | 5/2016 |
| WO | 2016/066442 | A1 | 5/2016 |
| WO | 2016/182696 | A1 | 11/2016 |

OTHER PUBLICATIONS

U.S. Appl. No. 14/485,188, filed Sep. 12, 2014, Pre-Interview First Office Action mailed Oct. 1, 2015, 10 pages.
U.S. Appl. No. 14/470,352, filed Aug. 27, 2014 Non Final Office Action mailed Nov. 20, 2015, 28 pages.
U.S. Appl. No. 12/700,310, filed Feb. 4, 2010 Final Office Action mailed Oct. 26, 2015, 19 pages.
Fong A.C.M. et al, "Indoor air quality control for asthma patients using smart home technology," Consumer Electronics (ISCE), 2011 IEEE 15th International Symposium On, IEEE, Jun. 14, 2011, pp. 18-19, XP032007803, DOI: 10.1109/ISCE.2011.5973774, ISBN: 978-1-61284-8433, Abstract and sections 3 and 4, 2 pages.
Shunfeng Cheng et al., "A Wireless Sensor System for Prognostics and Health Management," IEEE Sensors Journal, IEEE Service Center, New York, NY, US, vol. 10, No. 4, Apr. 1, 2010, pp. 856-862, XP011304455, ISSN: 1530-437X, Sections 2 and 3, 7 pages.
International Search Report and Written Opinion for PCT/EP2015/070286 mailed Nov. 5, 2015, 13 pages.
International Search Report and Written Opinion for PCT/GB2015/052544 mailed Nov. 6, 2015, 10 pages.
International Search Report and Written Opinion for PCT/GB2015/052457 mailed Nov. 13, 2015, 11 pages.
International Search Report and Written Opinion for PCT/EP2015/073299 mailed Jan. 4, 2016, 12 pages.
International Search Report and Written Opinion for PCT/EP2015/073936 mailed Feb. 4, 2016, all pages.
U.S. Appl. No. 14/107,132, filed Dec. 16, 2013, Final Rejection mailed Dec. 16, 2015, 32 pages.
U.S. Appl. No. 14/485,188, filed Sep. 12, 2014, Final Rejection mailed Feb. 23, 2016, 22 pages.
U.S. Appl. No. 14/567,348, filed Dec. 11, 2014, Preinterview first office action mailed Jan. 20, 2016, 23 pages.
U.S. Appl. No. 14/470,352, filed Aug. 27, 2014 Final Office Action mailed Mar. 17, 2016, all pages.
U.S. Appl. No. 14/567,765, filed Dec. 11, 2014, Preinterview first office action mailed Apr. 8, 2016, 30 pages.
U.S. Appl. No. 14/577,717, filed Dec. 19, 2014, Preinterview first office action mailed Apr. 4, 2016, 29 pages.
U.S. Appl. No. 14/584,075, filed Dec. 29, 2014, Non-Final Rejection mailed Apr. 1, 2016, 40 pages.
U.S. Appl. No. 14/107,132, filed Dec. 16, 2013 Non Final Office Action mailed May 27, 2015, 26 pages.
International Search Report and Written Opinion for PCT/US2016/028126 mailed Jun. 3, 2016, all pages.
U.S. Appl. No. 12/700,310, filed Feb. 4, 2010 Non-Final Office Action mailed Jun. 16, 2016, 30 pages.
U.S. Appl. No. 14/528,739, filed Oct. 30, 2014 Notice of Allowance mailed Jun. 23, 2016, 34 pages.
U.S. Appl. No. 14/485,188, filed Sep. 12, 2014, Non-Final Rejection mailed Jun. 17, 2016, 29 pages.
U.S. Appl. No. 14/710,331, filed May 12, 2015, Non-Fonal Rejection mailed May 20, 2016, 42 pages.
International Preliminary Report on Patentability for PCT/US2014/055441 issued Jun. 14, 2016, 8 pages.
International Preliminary Report on Patentability for PCT/US2014/053876 issued Jun. 14, 2016, 7 pages.
International Preliminary Report on Patentability for PCT/US2014/055476 issued Jun. 14, 2016, 9 pages.
U.S. Appl. No. 14/470,352, filed Aug. 27, 2014 Non Final Office Action mailed Aug. 26, 2016, all pages.
U.S. Appl. No. 14/107,132, filed Dec. 16, 2013, Non Final Office Action mailed Jul. 18, 2016, all pages.
U.S. Appl. No. 14/715,248, filed May 18, 2015, Non-Final Rejection mailed Jul. 19, 2016, 34 pages.
U.S. Appl. No. 14/567,783, filed Dec. 11, 2014, Non Final Rejection mailed Aug. 23, 2016, all pages.
"Acoustic/Ultrasound Ultrasonic Flowmeter Basics," Questex Media Group LLC, accessed on Dec. 16, 2014, 4 pages. Retrieved from http://www.sensorsmag.com/sensors/acoustic-ultrasound/ultrasonic-flowmeter-basics-842.
Author Unknown, "AllJoyn Onboarding Service Frameworks," Qualcomm Connected Experiences, Inc., accessed on Jul. 15, 2014, 9 pages. Retrieved from https://www.alljoyn.org.
Author Unknown, "App for Samsung Smart TV®," Crestron Electronics, Inc., accessed on Jul. 14, 2014, 3 pages. Retrieved from http://www.crestron.com/products/smart tv television apps/.
Author Unknown, "Voice Activated TV using the Amulet Remote for Media Center," AmuletDevices.com, accessed on Jul. 14, 2014, 1 page. Retrieved from http://www.amuletdevices.com/index.php/Features/television.html.
"Do you want to know how to find water leaks? Use a Bravedo Water Alert Flow Monitor to find out!", Bravedo.com, accessed Dec. 16, 2014, 10 pages. Retrieved from http://bravedo.com/.
"Flow Pulse®, Non-invasive clamp-on flow monitor for pipes," Pulsar Process Measurement Ltd, accessed on Dec. 16, 2014, 2 pages.Retrieved from http://www.pulsar-pm.com/product-types/flow/flow-pulse.aspx.
"International Building Code Excerpts, Updated with recent code changes that impact electromagnetic locks," Securitron, Assa Abloy, IBC/IFC 2007 Supplement and 2009, "Finally-some relief and clarification", 2 pages.Retrieved from: www.securitron.com/Other/.../New_IBC-IFC_Code_Language.pdf.
"Introduction to Ultrasonic Doppler Flowmeters," OMEGA Engineering inc., accessed on Dec. 16, 2014, 3 pages. Retrieved from http://www.omega.com/prodinfo/ultrasonicflowmeters.html.
Lamonica, M., "CES 2010 Preview: Green comes in many colors," retrieved from CNET.com (http://ces.cnet.com/8301-31045_1-10420381-269.html), Dec. 22, 2009, 2 pages.
Robbins, Gordon, Deputy Chief, "Addison Fire Department Access Control Installation," 2006 International Fire Code, Section 1008.1.3.4, 4 pages.
"Ultrasonic Flow Meters," RS Hydro Ltd, accessed on Dec. 16, 2014, 3 pages. Retrieved from http://www.rshydro.co.uk/ultrasonic-flowmeter.shtml.
Wang et al., "Mixed Sound Event Verification on Wireless Sensor Network for Home Automation," IEEE Transactions on Industrial Informatics, vol. 10, No. 1, Feb. 2014, 10 pages.
International Search Report and Written Opinion for PCT/EP2011/051608 mailed on May 30, 2011, 13 pages.
International Preliminary Report on Patentability for PCT/EP2011/051608 mailed Aug. 16, 2012, 8 pages.

(56) References Cited

OTHER PUBLICATIONS

International Search Report and Written Opinion for PCT/US2014/053876 mailed Nov. 26, 2014, 8 pages.
International Search Report and Written Opinion for PCT/US2014/055441 mailed Dec. 4, 2014, 10 pages.
International Search Report and Written Opinion for PCT/US2014/055476 mailed Dec. 30, 2014, 10 pages.
Mexican Institute of Industrial Property Office Action dated Nov. 1, 2013, for Mex. Patent Appln No. MX/a/2012/008882, 3 pages.
Mexican Institute of Industrial Property Notice of Allowance dated Feb. 10, 2014, for Mex. Patent Appln No. MX/a/2012/008882, 1 page.
U.S. Appl. No. 13/680,934, filed Nov. 19, 2012 Non-Final Office Action mailed Oct. 2, 2013, 7 pages.
U.S. Appl. No. 13/680,934, filed Nov. 19, 2012 Final Office Action mailed Feb. 10, 2014, 13 pages.
U.S. Appl. No. 13/680,934, filed Nov. 19, 2012 Notice of Allowance mailed Apr. 30, 2014, 9 pages.
U.S. Appl. No. 13/680,934, filed Nov. 19, 2012 Notice of Allowance mailed Jul. 25, 2014, 12 pages.
U.S. Appl. No. 12/700,408, filed Feb. 4, 2010 Notice of Allowance mailed Jul. 28, 2012, 8 pages.
U.S. Appl. No. 12/700,310, filed Feb. 4, 2010 Office Action mailed May 4, 2012, 15 pages.
U.S. Appl. No. 12/700,310, filed Feb. 4, 2010 Final Office Action mailed Oct. 10, 2012, 16 pages.
U.S. Appl. No. 12/700,310, filed Feb. 4, 2010 Non-Final Office Action mailed Apr. 1, 2013, 16 pages.
U.S. Appl. No. 12/700,310, filed Feb. 4, 2010 Non-Final Office Action mailed Oct. 15, 2013, 15 pages.
U.S. Appl. No. 12/700,310, filed Feb. 4, 2010 Final Office Action mailed Feb. 28, 2014, 17 pages.
U.S. Appl. No. 12/700,310, filed Feb. 4, 2010 Non-Final Office Action mailed Aug. 14, 2014, 18 pages.
U.S. Appl. No. 12/700,310, filed Feb. 4, 2010 Non-Final Office Action mailed Mar. 11, 2015, 35 pages.
International Search Report and Written Opinion for PCT/US2016/057729 mailed Mar. 28, 2017, all pages.
European Search Report for EP 16 20 0422 dated Jan. 13, 2017, all pages.
BDEJONG_CREE, "Cannot remove last user of a group even though members still exist," Microsoft Visual Studio forum site, Topic D #58405, Response by Microsoft, Dec. 17, 2010) retrieved on Apr. 6, 2017 from: https://connect.microsoft.com/VisualStudio/feedback/details/580405/tfs-2010-cannont-remove-last-user-of-a-group-even-though-members-still-exists.
International Preliminary Report on Patentability for PCT/GB2015/052457 issued Feb. 28, 2017, all pages.
U.S. Appl. No. 14/107,132, filed Dec. 16, 2013, Notice of Allowance mailed Jan. 18, 2017, all pages.
U.S. Appl. No. 14/567,765, filed Dec. 11, 2014, Final Rejection mailed Feb. 16, 2017, all pages.
U.S. Appl. No. 14/485,038, filed Sep. 12, 2014, Non Final Rejection mailed Apr. 6, 2017, all pages.
U.S. Appl. No. 14/584,073 , filed Dec. 29, 2014, Non-Final Rejection mailed Mar. 10, 2017, all pages.
U.S. Appl. No. 14/710,331, filed May 12, 2015, Non-Final Rejection mailed Mar. 10, 2017, all pages.
U.S. Appl. No. 14/566,977, filed Dec. 11, 2014, Final Rejection mailed Feb. 10, 2017, all pages.
U.S. Appl. No. 14/565,853, filed Dec. 10, 2014, Non Final Rejection mailed Mar. 10, 2017, all pages.
U.S. Appl. No. 14/497,130, filed Sep. 25, 2014, Non Final Rejection mailed Feb. 8, 2017, all pages.
U.S. Appl. No. 12/700,310, filed Feb. 4, 2010 Notice of Allowance mailed Nov. 8, 2016, all pages.
U.S. Appl. No. 14/567,765, filed Dec. 11, 2014, First Action interview mailed Oct. 18, 2016, all pages.
U.S. Appl. No. 14/584,075, filed Dec. 29, 2014, Final Rejection mailed Oct. 6, 2016, all pages.
U.S. Appl. No. 14/566,977, filed Dec. 11, 2014, Non Final Rejection mailed Oct. 3, 2006, all pages.
U.S. Appl. No. 14/567,754, filed Dec. 11, 2014, Non Final Rejection mailed Nov. 4, 2016, all pages.
U.S. Appl. No. 14/567,770, filed Dec. 11, 2014, Non Final Rejection mailed Nov. 4, 2016, all pages.
U.S. Appl. No. 14/476,377, filed Sep. 3, 2014, Non-Final Rejection mailed Nov. 7, 2016, all pages.
Office Action for EP14868928.4 dated Sep. 23, 2016, all pages.
U.S. Appl. No. 14/470,352, filed Aug. 27, 2014 Notice of Allowance mailed Dec. 2, 2016, all pages.
U.S. Appl. No. 15/050,958, filed Feb. 23, 2016 Notice of Allowance mailed Dec. 6, 2016, all pages.
U.S. Appl. No. 15/289,395, filed Oct. 10, 2016 Non-Final Rejection mailed Dec. 2, 2016, all pages.
U.S. Appl. No. 14/485,188, filed Sep. 12, 2014, Final Rejection mailed Nov. 25, 2016, 22 pages.
U.S. Appl. No. 14/577,717, filed Dec. 19, 2014, Final Office Action mailed Dec. 19, 2016, all pages.
U.S. Appl. No. 14/567,783, filed Dec. 11, 2014, Final Rejection mailed Dec. 20, 2016, all pages.
U.S. Appl. No. 15/075,412, filed Mar. 21, 2016, Non Final Rejection mailed Dec. 21, 2016, all pages.

* cited by examiner

HOME AUTOMATION SOUND DETECTION AND POSITIONING

BACKGROUND

Stray noises in and around a home are a common occurrence. Whether the sound is a neighbor's barking dog, beeping electronics, a gunshot, or some other sound, the source of such sounds can be difficult to identify, perhaps especially if the sound is not recurring. A person may find it useful to know the location of the source of the sound is such that the person can determine a proper action to take in response to the sound. For instance, if a neighbor's dog is barking daily at 6 AM, the person may discuss the situation with the neighbor.

SUMMARY

Systems, methods, devices, non-transitory computer-readable mediums, and apparatuses are presented for detecting and positioning sound in a home automation system installed at a structure. In some embodiments, a first indication of a sound and a first timestamp may be received from a first home automation device by a home automation host system. A second indication of the sound and a second timestamp may be received from a second home automation device by the home automation host system. In some embodiments, a third indication of the sound and a third timestamp may be received from a third home automation device by the home automation host system. Using the first indication, the second indication, and the third indication, it may be determined a sound magnitude for the sound and whether the sound originated inside or outside of the structure. The sound magnitude may be compared to an inside sound threshold level if the sound was determined to originate inside the structure or compared to an outside sound threshold level if the sound was determined to originate outside the structure. Sound information corresponding to the sound may be logged if the sound was determined to originate inside and the sound magnitude exceeds the inside sound threshold level or the sound was determined to originate outside and the sound magnitude exceeds the outside sound threshold level.

Additionally, various embodiments may include one or more of the following features: A notification of the sound may be transmitted to a user device if the sound was determined to originate inside and the sound magnitude exceeds the inside sound threshold level, or the sound was determined to originate outside and the sound magnitude exceeds the outside sound threshold level, the outside sound threshold level being greater than the inside sound threshold level. At least one of the first indication, the second indication, and the third indication may include a recording of the sound. The recording of the sound may be stored if the sound was determined to originate inside and the sound magnitude exceeds the inside sound threshold level, or the sound was determined to originate outside and the sound magnitude exceeds the outside sound threshold level. Determining whether the sound originated inside or outside of the structure may include determining, by the home automation host system, a direction from which the sound originated. The recording of the sound may be compared to one or more stored recordings of sounds previously logged. The recording of the sound may be determined to match the one or more stored recordings of sounds previously logged. An indication of a recurring sound may be stored based on the recording of the sound being determined to match the one or more stored recordings of sounds previously logged.

Additionally or alternatively, embodiments may include one or more of the following features: Via a display device, an interface may be output that presents entries corresponding to logged sound information. The interface, for the logged sound information, may indicate: a direction from which the sound originated; an indication of whether the sound originated inside or outside of the structure; and an option to playback the recording of the sound. The interface, for the logged sound information, may further indicate: a number of times sounds similar to the logged sound information has been logged. Determining, by the home automation host system, using the first indication, the second indication, and the third indication, whether the sound originated inside or outside of the structure, may include performing a time-of-flight analysis using the first timestamp, the second timestamp, and the third timestamp. The first home automation device may be located on an exterior of the structure and the second home automation device and the third home automation device may be located inside the structure. The first home automation device, the second home automation device, and the third home automation device may have a primary purpose other than collecting sound for identifying environmental sound sources.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Being able to determine where sounds originate and maintain a record of such sounds may be useful for an occupant of a home. An occupant may be interested in both sounds that originate outside of the structure (e.g., home, building, office, etc.) and within the structure. Depending on where a sound originates, the magnitude (volume) of the sound may be used to determine whether the sound should be ignored or logged. For instance, a user may have no use for logging of everyday noises that occur inside and outside of the structure. A user or content service provider may define threshold sound levels that may be used to determine whether a sound should be logged. Different sound threshold levels may be used for sounds determined to originate inside versus outside. Further, the sound threshold level may vary, based on the time of day and/or the day of the week. For example, a user may not wish to record loud sounds occurring at 10 PM on a Saturday night, but would wish to log such sounds if the sounds occurred at the same time on a Tuesday night.

Home automation devices located throughout a user's home or other form of structure may have one or more onboard microphones. Such microphones may have a primary use related to the particular home automation device (e.g., for receiving voice commands), but may also be used for sensing environmental sound and providing indications of such sound to a home automation host system. Based on sound information received from multiple home automation devices that are distributed throughout a home or other form of structure, the home automation host system may be able to determine a general location (e.g., in a particular room) or at least the direction (e.g., northwest of the structure) from which the sound originated. Further, based on the sound information received from multiple home automation devices, the home automation host system may be able to determine a volume (e.g., decibel level) of the sound.

The home automation host system may log information related to sounds that qualify based on a current threshold volume being enforced. The home automation host system may be able to provide an interface to allow a user to review sounds that were logged and, possibly, playback recordings of such sounds. The home automation host system may analyze such logged sounds against each other to determine if a particular sound is reoccurring—for instance, if a particular neighbor's dog has barked loudly several times. The log may note that the sound is recurring and may note the other times at which the same sound has occurred. These aspects and various other details of the embodiments are detailed below in relation to the figures.

Figure 1:
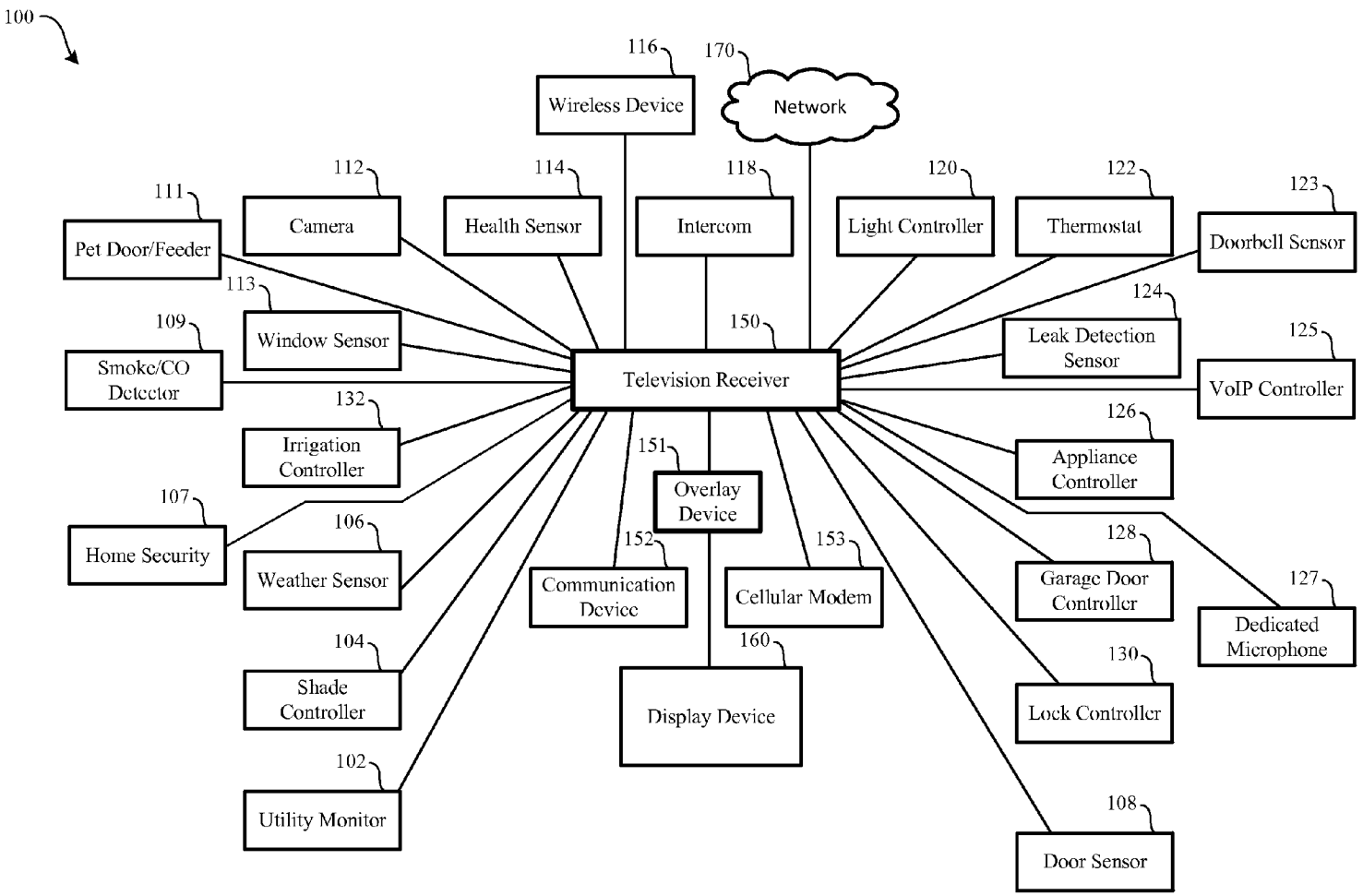
FIG. 1 illustrates an exemplary home automation system.

A home automation system that includes multiple home automation devices and a home automation host may perform such sound analysis, identification, and position. FIG. 1 illustrates an embodiment of a home automation system 100 hosted by a television receiver. Television receiver 150 may be configured to receive television programming from a satellite-based television service provider; in other embodiments, other forms of television service provider networks may be used, such as an IP-based network (e.g., fiber network), a cable based network, a wireless broadcast-based network, etc.

Television receiver 150 may be configured to communicate with various home automation devices. The devices with which television receiver 150 communicates may use different communication standards. For instance, one or more devices may use a ZigBee® communication protocol while one or more other devices communicate with the television receiver using a Z-Wave® communication protocol. Other forms of wireless communication may be used by devices and the television receiver. For instance, television receiver 150 and one or more devices may be configured to communicate using a wireless local area network, which may use a communication protocol such as IEEE 802.11.

In some embodiments, a separate device may be connected with television receiver 150 to enable communication with home automation devices. For instance, communication device 152 may be attached to television receiver 150. Communication device 152 may be in the form of a dongle. Communication device 152 may be configured to allow for Zigbee®, Z-Wave®, and/or other forms of wireless communication. The communication device may connect with television receiver 150 via a USB port or via some other type of (wired) communication port. Communication device 152 may be powered by the television receiver or may be separately coupled with a power source. In some embodiments, television receiver 150 may be enabled to communicate with a local wireless network and may use communication device 152 in order to communicate with devices that use a ZigBee® communication protocol, Z-Wave® communication protocol, and/or some other home wireless communication protocols.

Communication device 152 may also serve to allow additional components to be connected with television receiver 150. For instance, communication device 152 may include additional audio/video inputs (e.g., HDMI), a component, and/or a composite input to allow for additional devices (e.g., Blu-ray players) to be connected with television receiver 150. Such connection may allow video from such additional devices to be overlaid with home automation information. Whether home automation information is overlaid onto video may be triggered based on a user's press of a remote control button.

Regardless of whether television receiver 150 uses communication device 152 to communicate with home automation devices, television receiver 150 may be configured to output home automation information for presentation to a user via display device 160, which may be a television, monitor, or other form of device capable of presenting visual information. Such information may be presented simultaneously with television programming received by television receiver 150. Television receiver 150 may also, at a given time, output only television programming or only home automation information based on a user's preference. The user may be able to provide input to television receiver 150 to control the home automation system hosted by television receiver 150 or by overlay device 151, as detailed below.

In some embodiments, television receiver 150 may not be used as a host for a home automation system. Rather, a separate device may be coupled with television receiver 150 that allows for home automation information to be presented to a user via display device 160. This separate device may be coupled with television receiver 150. In some embodiments, the separate device is referred to as overlay device 151. Overlay device 151 may be configured to overlay (or separately output) information, such as home automation information, onto a signal to be visually presented via display device 160, such as a television. In some embodiments, overlay device 151 may be coupled between television receiver 150, which may be in the form of a set top box (STB), and display device 160, which may be a television, monitor, or other form of presentation device. In such embodiments, television receiver 150 may receive, decode, descramble, decrypt, store, and/or output television programming. Television receiver 150 may output a signal, such as in the form of an HDMI signal. Rather than be directly input to display device 160, the output of television receiver 150 may be input to overlay device 151. Overlay device 151 may receive the video and/or audio output from television receiver 150. Overlay device 151 may add additional information to the video and/or audio signal received from television receiver 150. The modified video and/or audio signal may be output to display device 160 for presentation. In some embodiments, overlay device 151 has an HDMI input and an HDMI output, with the HDMI output being connected to display device 160. To be clear, while FIG. 1 illustrates lines illustrating communication between television receiver 150 and various devices, it should be understood that such communication may exist, in addition or alternatively via communication device 152 and/or with overlay device 151. It should be understood that all of the home automation functions attributed to a home automation host in this document can be performed by television receiver 150 (if enabled for home automation) or by overlay device 151.

In some embodiments, television receiver 150 may be used to provide home automation functionality but overlay device 151 may be used to present information via display device 160. It should be understood that the home automation functionality detailed herein in relation to a television receiver may alternatively be provided via overlay device 151. In some embodiments, overlay device 151 may provide home automation functionality and be used to present information via display device 160. Using overlay device 151 to present automation information via display device 160 may have additional benefits. For instance, multiple devices may provide input video to overlay device 151. For instance, television receiver 150 may provide television programming to overlay device 151, a DVD/Blu-Ray player may provide video overlay device 151, and a separate internet-TV device may stream other programming to overlay device 151. Regardless of the source of the video/audio, overlay device 151 may output video and/or audio that has been modified to include home automation information and output to display device 160. As such, in such embodiments, regardless of the source of video/audio, overlay device 151 may modify the audio/video to include home automation information and, possibly, solicit for user input. For instance, in some embodiments, overlay device 151 may have four video inputs (e.g., four HDMI inputs) and a single video output (e.g., an HDMI output). In other embodiments, such overlay functionality may be part of television receiver 150. As such, a separate device, such as a Blu-ray player, may be connected with a video input of television receiver 150, thus allowing television receiver 150 to overlay home automation information when content from the Blu-Ray player is being output to display device 160.

Regardless of whether television receiver 150 is itself configured to provide home automation functionality and output home automation input for display via display device 160 or such home automation functionality is provided via overlay device 151, home automation information may be presented by display device 160 while television programming is also being presented by display device 160. For instance, home automation information may be overlaid or may replace a portion of television programming (e.g., broadcast content, stored content, on-demand content, etc.) presented via display device 160.

Television receiver 150 or overlay device 151 may be configured to communicate with one or more wireless devices, such as wireless device 116. Wireless device 116 may represent a tablet computer, cellular phone, laptop computer, remote computer, or some other device through which a user may desire to control home automation settings and view home automation information. Such a device also need not be wireless, such as a desktop computer. Television receiver 150, communication device 152, or overlay device 151 may communicate directly with wireless device 116, or may use a local wireless network, such as network 170. Wireless device 116 may be remotely located and not connected with a same local wireless network. Via the Internet, television receiver 150 or overlay device 151 may be configured to transmit a notification to wireless device 116 regarding home automation information. For instance, in some embodiments, a third-party notification server system, such as the notification server system operated by Apple®, may be used to send such notifications to wireless device 116.

In some embodiments, a location of wireless device 116 may be monitored. For instance, if wireless device 116 is a cellular phone, when its position indicates it has neared a door, the door may be unlocked. A user may be able to define which home automation functions are controlled based on a position of wireless device 116. Other functions could include opening and/or closing a garage door, adjusting temperature settings, turning on and/or off lights, opening and/or closing shades, etc. Such location-based control may also take into account the detection of motion via one or more motion sensors that are integrated into other home automation devices and/or stand-alone motion sensors in communication with television receiver 150.

In some embodiments, little to no setup of network 170 may be necessary to permit television receiver 150 (or overlay device 151) to stream data out to the Internet. For instance, television receiver 150 and network 170 may be configured, via a service such as Sling® or other video streaming service, to allow for video to be streamed from television receiver 150 to devices accessible via the Internet. Such streaming capabilities may be "piggybacked" to allow for home automation data to be streamed to devices accessible via the Internet. For example, U.S. patent application Ser. No. 12/645,870, filed on Dec. 23, 2009, entitled "Systems and Methods for Remotely Controlling a Media Server via a Network", which is hereby incorporated by reference, describes one such system for allowing remote access and control of a local device. U.S. Pat. No. 8,171,148, filed Apr. 17, 2009, entitled "Systems and Methods for Establishing Connections Between Devices Communicating Over a Network", which is hereby incorporated by reference, describes a system for establishing connection between devices over a network. U.S. patent application Ser. No. 12/619,192, filed May 19, 2011, entitled "Systems and Methods for Delivering Messages Over a Network", which is hereby incorporated by reference, describes a message server that provides messages to clients located behind a firewall.

Wireless device 116 may serve as an input device for television receiver 150. For instance, wireless device 116 may be a tablet computer that allows text to be typed by a user and provided to television receiver 150. Such an arrangement may be useful for text messaging, group chat sessions, or any other form of text-based communication. Other types of input may be received for the television receiver from a tablet computer or other device as shown in the attached screenshots, such as lighting commands, security alarm settings and door lock commands. While wireless device 116 may be used as the input device for typing text, television receiver 150 may output for display text to display device 160.

In some embodiments, a cellular modem 153 may be connected with either overlay device 151 or television receiver 150. Cellular modem 153 may be useful if a local wireless network is not available. For instance, cellular modem 153 may permit access to the Internet and/or communication with a television service provider. Communication with a television service provider may also occur via a local wireless or wired network connected with the Internet. In some embodiments, information for home automation purposes may be transmitted by a television service provider system to television receiver 150 or overlay device 151 via the television service provider's distribution network, which may include the use of satellites.

Various home automation devices may be in communication with television receiver 150 or overlay device 151. Such home automation devices may use disparate communication protocols. Such home automation devices may communicate with television receiver 150 directly or via communication device 152. Such home automation devices may be controlled by a user and/or have a status viewed by a user via display device 160 and/or wireless device 116. Home automation devices may include: door sensor 108, lock controller 130 (which may be integrated with door sensor 108), smoke/carbon monoxide detector 109, home security system 107, pet door/feeder 111, camera 112, window sensor 113, irrigation controller 132, weather sensor 106, shade controller 104, utility monitor 102, heath sensor 114, intercom 118, light controller 120, thermostat 122, leak detection sensor 124, appliance controller 126, garage door controller 128, doorbell sensor 123, and VoIP controller 125. Some or all of such home automation devices may have one or more on-board microphones. For at least some of these devices, the on-board microphone may have some primary purpose other than being used to determine the location and volume of environmental sounds. For example, intercom 118 may have a microphone to enable a user to speak to another user via the intercom. As another example, light controller 120 may have a microphone that has as its primary purpose collecting sound for use in identifying whether a room is occupied. An additional form of home automation device may be a dedicated microphone 127 for use determining the location and volume of environmental sounds.

Additional forms of sensors not illustrated in FIG. 1 may also be incorporated as part of a home automation system. For instance, a mailbox sensor may be attached to a mailbox to determine when mail is present and/or has been picked up. The ability to control one or more showers, baths, and/or faucets from television receiver 150, overlay device 151 and/or wireless device 116 may also be possible. Pool and/or hot tub monitors may be incorporated into a home automation system. Such sensors may detect whether or not a pump is running, water temperature, pH level, a splash/whether something has fallen in, etc. Further, various characteristics of the pool and/or hot tub may be controlled via the home automation system. In some embodiments, a vehicle dashcam may upload or otherwise make video/audio available to television receiver 150 (or overlay device 151) when within range. For instance, when a vehicle has been parked within range of a local wireless network with which television receiver 150 is connected, video and/or audio may be transmitted from the dashcam to the television receiver for storage and/or uploading to a remote server.

To be clear, all of the home automation functions detailed herein that are attributed to television receiver 150 may alternatively or additionally be incorporated into overlay device 151 or some separate computerized home automation host system.

Figure 2:
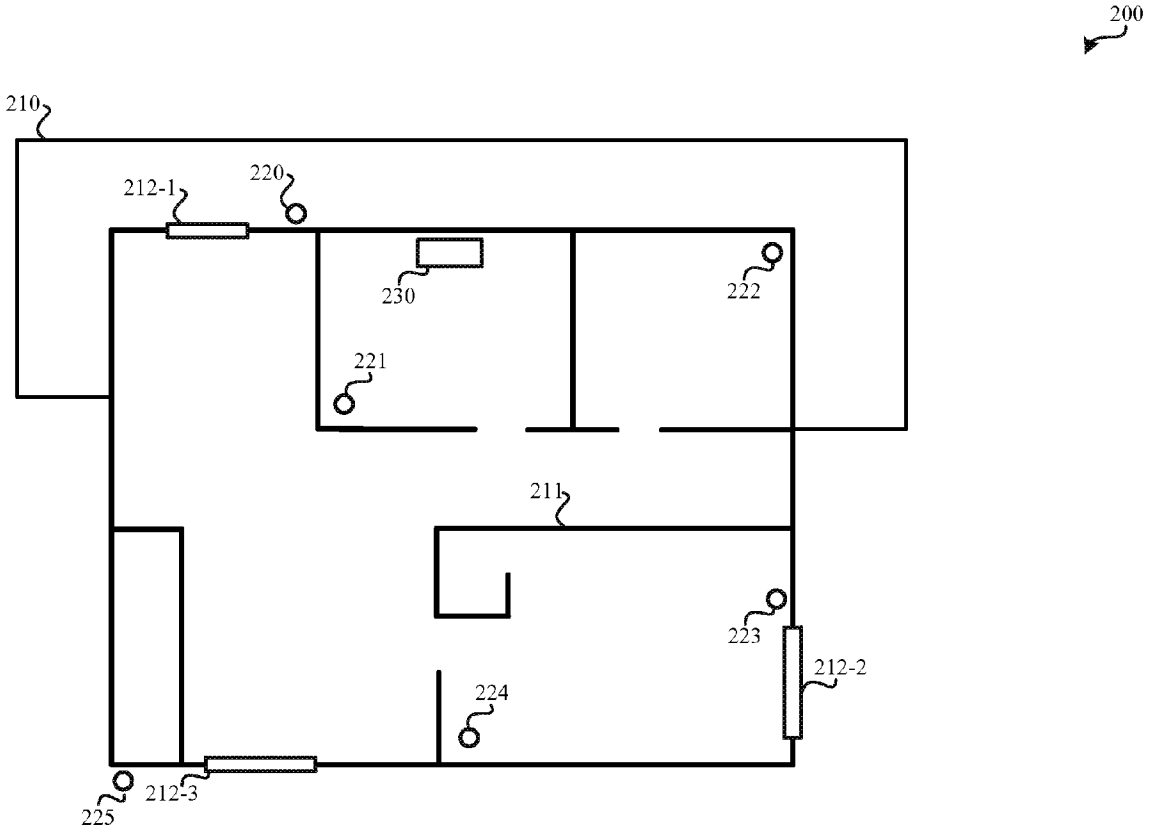
FIG. 2 illustrates an exemplary floor plan of a structure having multiple home automation devices.

FIG. 2 illustrates an exemplary floor plan 200 of a structure having multiple home automation devices. Floor plan 200 illustrates a structure, such as a home in which multiple home automation devices are installed within and around the home. Referring to floor plan 200, doors 212-1, 212-2, and 212-3 are present. Door 212-1 opens onto porch 210. Within the home, walls, such as wall 211 are present. Various home automation devices present in floor plan 200 include: video camera 220, light 221, smoke detector 222, video camera 223, dedicated microphone 224, video camera 225, and home automation host system 230 (which might be a television receiver or overlay device, as detailed in relation to FIG. 1). Home automation devices such as video camera 220 and light 221 may serve a primary purpose other than capturing audio. However, such devices may still have an onboard microphone. For instance, video camera 220 may have an onboard microphone to record sound made in the vicinity of door 212-1. Similarly, light 221 may have an onboard microphone used to primarily sense sound for use in determining whether any users are in the vicinity of light 221.

In some embodiments, home automation host system 230, which may be a television receiver (e.g., set top box) or an overlay device in communication with such a television receiver, may be in communication either directly or indirectly, with each of the home automation devices 220 through 225. Such home automation devices may be programmed to use their onboard microphones to sense sound. When a sensed sound exceeds a particular sound threshold, information regarding the sound may be transmitted to home automation host system 230. Each home automation device may have its own stored sound threshold level which is used to determine when sound information is transmitted to the home automation host system. In other embodiments, home automation host system 230 may provide some or all of home automation devices 220 through 225 with defined threshold levels. For instance, home automation host system 230 may provide threshold levels that vary based on the time and day of the week. As such, home automation host system 230 may update the threshold level used by each of home automation devices 220 through 225 as necessary in accordance with a schedule, or may provide a separate, higher threshold that is used to pre-screen sounds, thus preventing an overly large amount of sound data from being transmitted by such home automation devices 220-225 to home automation host system 230. For instance, in such embodiments, pre-filtering of sounds may be performed at the home automation devices, with the final determination as to whether the sound is to be logged being made using separate threshold levels at the home automation host system 230.

When the sound occurs either inside or outside the structure represented by floor plan 200, multiple of home automation devices 220 through 225, and possibly home automation host system 230 itself, may receive and record the sound (or at least capture information about the sound). If at least a preliminary threshold level is met, information about the sound, or the recording of the sound itself, may be transmitted by some or all of home automation devices 220 through 225 to home automation host system 230. This information transmitted to home automation host system 230 may include at least: a measured volume of the sound (e.g., a decibel level); and a timestamp. Each home automation device 220 through 225 may coordinate its onboard clock with home automation host system 230 such that the time maintained by each home automation device is consistent. Therefore, periodically, home automation host system 230 may update each home automation device with the time as determined by home automation host system 230. The timestamp information received from multiple home automation devices by home automation host system 230 may be used for a time of flight analysis on the sound. By comparing the timestamps received from multiple home automation devices 220 through 225, a location or general direction from which the sound originated may be determined by home automation host system 230. To determine a relatively accurate location from where the sound originated, it may be necessary for at least three of the home automation devices to provide sound information to home automation host system 230 (or at least two devices if the home automation host system 230 itself captured information about the sound). The greater the number of home automation devices that provide information about the sound including a timestamp in which the sound was detected by the home automation device, to home automation host system 230, the more accurate the origination location of the sound may be determined.

In some embodiments, home automation host system 230 may be provided with a floor plan similar to floor plan 200 along with indications of locations of home automation devices 220 through 225 in order to allow home automation host system 230 to determine the general location from which particular detected sound originated. Home automation host system 230 may provide a user with an interface that allows for input (e.g., upload) of a floor plan or at least for a user to draw or otherwise map out a basic floor plan of the structure in which home automation host system 230 is present. The user may further provide home automation host system 230 with locations of home automation devices 220 through 225 on the floor plan. The user may additionally provide a location of where home automation host system 230 itself is located. The more accurate of a floor plan and locations of home automation devices 220 through 225 and home automation host system 230 that are provided by the user, the more accurate determinations of the origination directions or locations of sounds by home automation host system 230 may be. In other embodiments, without a user providing a floor plan and/or indications of locations of home automation devices 220 through 225, home automation host system 230 may be able to discover relative locations of such home automation devices. For instance, home automation devices 220 through 225 may be pinged to determine a distance (and, possibly a direction) from the home automation host system to the home automation device. Communication among home automation devices 220 through 225 may further be used to determine distances and directions between such home automation devices.

Figure 3:
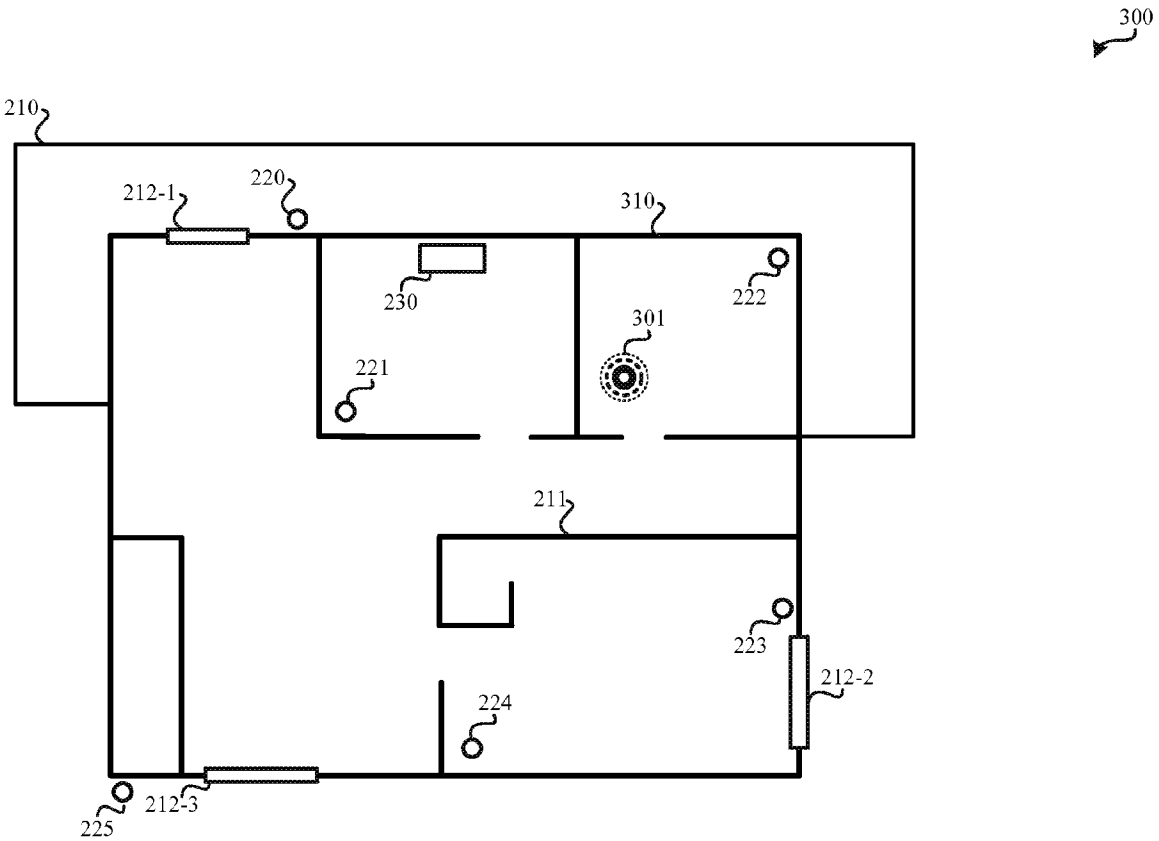
FIG. 3 illustrates an exemplary floor plan of a structure at which an internal sound was sensed.

FIG. 3 illustrates an exemplary floor plan 300 of a structure at which an internal sound was sensed. Floor plan 300 may represent the same floor plan as in FIG. 2. In the structure, as indicated on floor plan 300, a sound 301 has occurred. This sound 301 may exceed the threshold sound levels of at least some of home automation devices 220 through 225. In this example, sound 301 has been detected by home automation devices 222, 221, 223, and 220. Sound 301 was also detected by home automation host system 230.

Each of these home automation devices may send information about sound 301 to home automation host system 230. Home automation host system 230 may first confirm that the sound information received from each of these home automation devices corresponds to the same sound. This analysis may be done by comparing recordings of the sound provided by each of the home automation devices to home automation host system 230 and/or by determining the information about how the sound relates to the same sound 301 based on timestamp information. Home automation host system 230 may determine a location or direction from which sound 301 originated based on information received from each home automation device indicative of a magnitude of the sound and timestamp information. For instance, home automation device 222 may indicate that sound 301 had a greater magnitude than the sound information provided to home automation host system 230 by home automation device 220. Based on timestamp information, home automation host system 230 may determine that sound 301 occurred closer to home automation device 222 than home automation device 220. Home automation host system 230 may determine based, on timestamp information, that sound 301 occurred roughly equidistant from home automation device 221 and home automation device 223. A particular threshold (e.g., a threshold for internal sounds, the threshold may additionally or alternatively vary by time of day and/or day of week) may then be compared with the determined volume of the sound by the home automation host system 230. If the sound exceeds the threshold, the sound may continue to be processed and logged.

Based on its analysis of timestamp information and/or sound magnitude information, home automation host system 230 may determine the location of sound 301 is within room 310. The location and time of the sound may be logged by home automation host system 230. If home automation host system 230 has received from at least one of the home automation devices a recording of the sound, such a recording may be stored in relation with the log information. In other embodiments, home automation host system 230 may itself record and store audio corresponding to the time of sound 301. Further, home automation host system 230 may classify sound 301 as having occurred within the home. This classification may also be stored as part of the log information.

Figure 4:
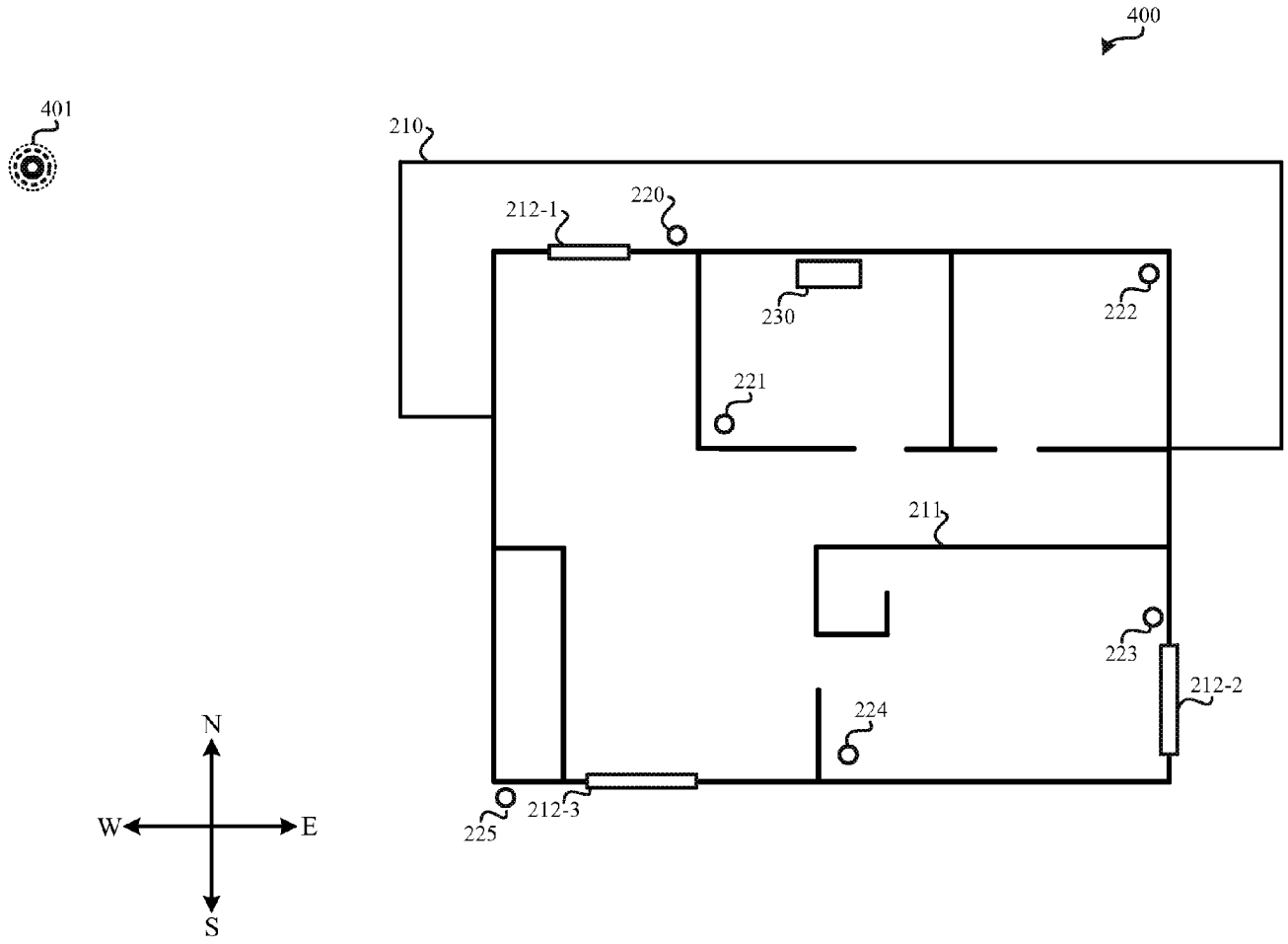
FIG. 4 illustrates an exemplary floor plan of a structure at which an external sound was sensed.

FIG. 4 illustrates an exemplary floor plan 400 of a structure at which an external sound was sensed. Floor plan 400 may represent the same floor plan as in FIGS. 2 and 3. Outside the structure, as indicated on floor plan 400, a sound 401 has occurred. Sound 401 may exceed the threshold sound levels of at least some of home automation devices 220 through 225. In this example, sound 401 has been detected by home automation devices 220, 221, and 225. Sound 401 was also detected directly by home automation host system 230.

Each of these home automation devices (220, 221, and 225) may send information about sound 401 to home automation host system 230. This sound information may include at least a measure of volume (e.g., a decibel level) and a timestamp. Some home automation devices may send a recording of the sound (e.g., at the request of home automation host system 230) or without a request. Home automation host system 230 may first confirm that the sound information received from each of these home automation devices corresponds to the same sound. Home automation host system 230 may determine an estimated mean, or median volume of the sound based on the sound information received from the various home automation devices. Home automation host system 230 may also determine a general location of sound 401 based on information received from each home automation device (home automation devices 220, 221, and 225) and the information recorded directly by home automation host system 230. For instance, home automation device 220 may indicate that sound 401 was much louder than the sound information provided to home automation host system 230 by home automation device 221. Based on timestamp information, home automation host system 230 may determine that sound 401 occurred closer to home automation device 220 than home automation host system 230. A particular threshold (e.g., a threshold for external sounds, the threshold may additionally or alternatively vary by time of day and/or day of week) may then be compared with the determined volume of the sound. If the sound exceeds the threshold, the sound may continue to be processed and logged.

Based on its analysis of timestamp information and sound magnitude information, home automation host system 230 may determine the location of sound 401 is roughly west of the structure. The location and time of sound 401 may be logged by home automation host system 230. If home automation host system 230 has received from one of the home automation devices a recording of sound 401, such a recording may be stored in relation with the log information. In other embodiments, home automation host system 230 may itself record and store audio corresponding to the time of sound 401. Further, home automation host system 230 may classify sound 401 as having occurred outside the structure. This classification may also be stored as part of the log information.

Figure 5:
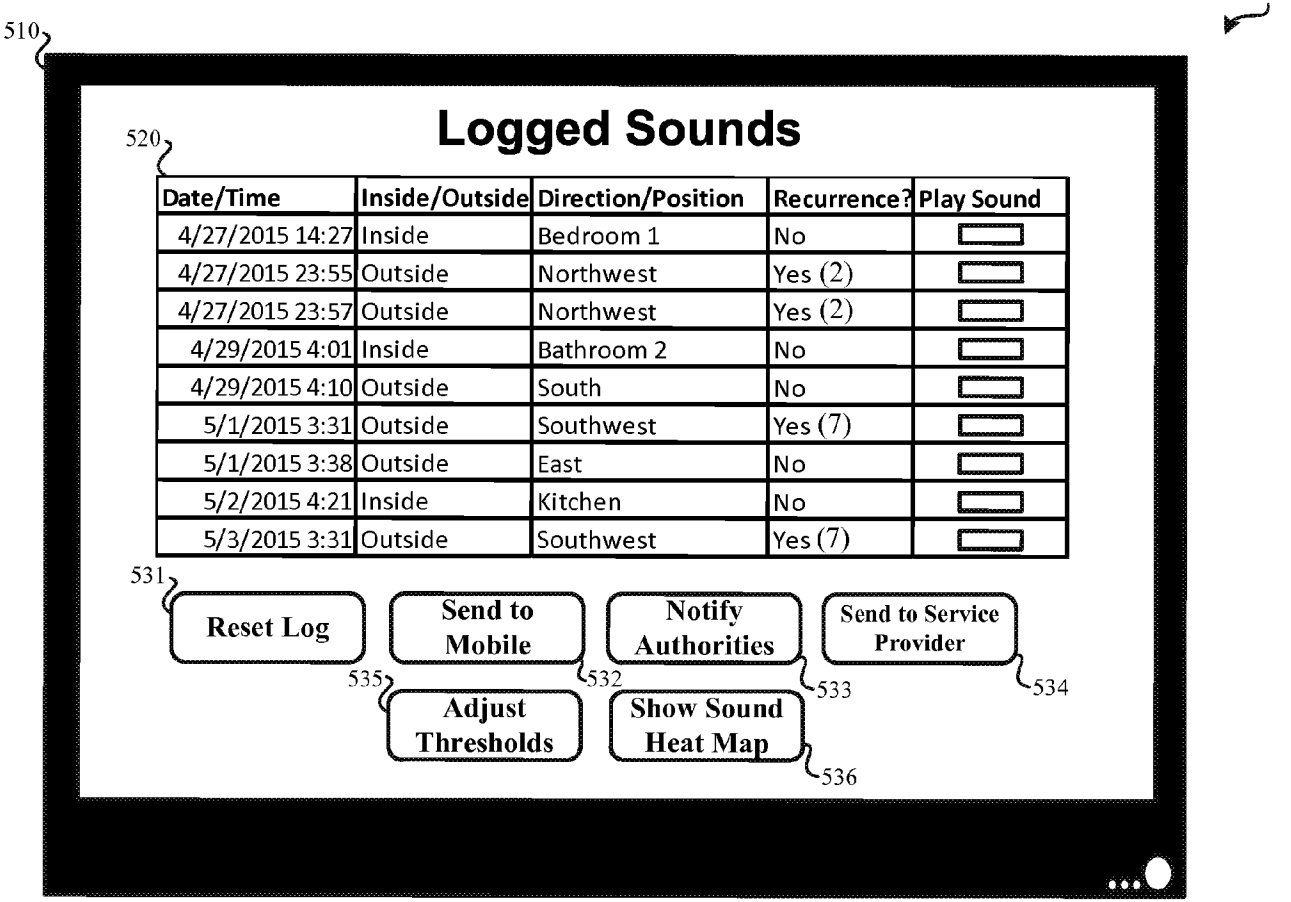
FIG. 5 illustrates an embodiment of a sound log interface through which a user can monitor logged sounds.

FIG. 5 illustrates an embodiment 500 of a sound log interface through which a user can monitor logged sounds. A home automation host system, such as home automation host system 230, may output such an interface for display to a display device, such as a television. Additionally or alternatively, such an interface may be presented on a user device, such as a smartphone, tablet computer, laptop, or other form of computerized device. In such embodiments, the computerized device may receive information transmitted by home automation host system 230. It should be understood that the graphical presentation and arrangement of data in FIG. 5 as presented on display device 510 is merely exemplary; in other embodiments, such data may be rearranged, and/or more data or less data may be displayed.

Table 520 presents a listing of sounds that have been logged by the home automation host system. For each sound that has been logged, a date and time is stored that corresponds to when the sound was detected by home automation devices. Also logged may be an indication of whether the sound was determined to originate inside and outside. If a more precise direction and/or position is available, such a direction/position can be recorded as part of the log. "Recurrence" is determined by the host system comparing a recording of a logged sound against previous instances of logged sounds to determine if any of such sounds appear to match. A sound may be determined to match if it originates from roughly the same location/direction and a comparison of audio recordings of such sounds is indicative of a match. If the sound is determined to be a recurring sound, an indication may be presented in the recurrence column of how many times that sound has recurred since the log was last reset. Additionally present in table 520 may be an option for user to select if the user desires to hear a recording of the sound. This may be useful for the user to be able to identify the source of the sound. For example, user may desire to review a sound recorded in the middle of the night to determine if it is something innocuous, such as a barking dog, or something more sinister, such as gunfire.

Various options may be available to user in order to control and interact with the logged sounds. Reset log element 531 may allow a user to clear previously logged sounds from table 520. Send to mobile element 532 may permit a user to cause one or more logged sounds to have its information and/or recording of the sound transmitted to a mobile device, such as smart phone or tablet computer. Notify authorities element 533 may permit a user to notify the relevant authorities, such as the police department, about all or particular logged sounds. For instance, an email may be created that lists particular logged sounds corresponding to a particular or origination direction or position. For instance, such information may be useful if a user desires to file a notice complaint about a neighbor due to a recurring sound. As an example, the sound logged on May 1, 2015 at 3:31 AM has recurred seven times and is recorded as originating from a southwest direction. This high level of recurrence may prompt the user to want to notify the authorities in order to register a formal noise complaint against a neighbor who has his home in that direction.

Send to service provider element 534 may allow the user to send log sounds to a service provider, such as the user's television service provider. This may allow the service provider to compare the log sounds with other sounds that have been logged by other users in the general vicinity. By collecting information from multiple home automation systems, more accurate information about environmental sounds in the neighborhood may be determined by the service provider, including more accurate information as to where particular sounds originate. As an example, on Apr. 27, 2015 at 11:55 PM, a sound was detected outside in the northwest direction. This information, when uploaded to a service provider, may be cross-referenced with sound information provided by another user that indicates a sound corresponding to that date and time in the same neighborhood. This service providers' system may compare recordings of the two sounds and determine that they are likely one and the same. The respective users may be contacted with more accurate information indicating an origination location of the sound and/or a likely cause.

Another option that may be present for the user is adjust thresholds element 535. Adjust thresholds element 535 may permit the user to define one or more thresholds. A user may define different thresholds to control which sounds are logged and which sounds are discarded. Different thresholds may be defined for sounds that originate inside versus outside the structure. Different thresholds may also be defined for different times of the day (e.g., during the day compared to during the night) and different days of the week. It may be possible to define vacation thresholds too: for instance, when the user is away on vacation, a much lower threshold may be desired for sounds occurring within the home. Another option that may be present may be the ability of the user to view a sound heat map such as by selecting show sound heat map element 536. Selection of such element may cause the home automation host system to output a graphical interface that presents a floor plan of the structure along with the locations or directions from which sounds originated. Various directions and positions located on the heat map may be presented in different colors or with various other graphical emphases to indicate magnitude of the sound from such a direction/position and/or frequency of sound logged from such a direction/position. Such a heat map may be useful for determining which neighbor is particularly noisy. It should be understood that, in other embodiments, sound magnitude information may be presented in different format; for instance, table 520 may have a column that indicates a calculated volume of each logged sound. Such a calculated volume may be a mean or median volume measured across multiple home automation devices or, possibly, could be the maximum volume recorded by one of the home automation devices that sensed the sound.

A home automation host system, such as via an interface similar to embodiment 500, may be able to present a questionnaire to a user. Answers to this questionnaire may be useful for the host system in determining whether future sounds occurred inside or outside of the structure. For instance, if a questionnaire question such as "Do you have a dog?" is answered in the negative, if a dog bark is detected, the host system may be more likely to indicate that the sound originated outside. Other possible questions may include: "Do you have young children?"; "Do you have a housekeeper who enters the house when you are away?"; and "Do you have a doorbell?" These are possible questionnaire questions that could be used to help the host system determine the origination location of particular sounds.

Figure 6:
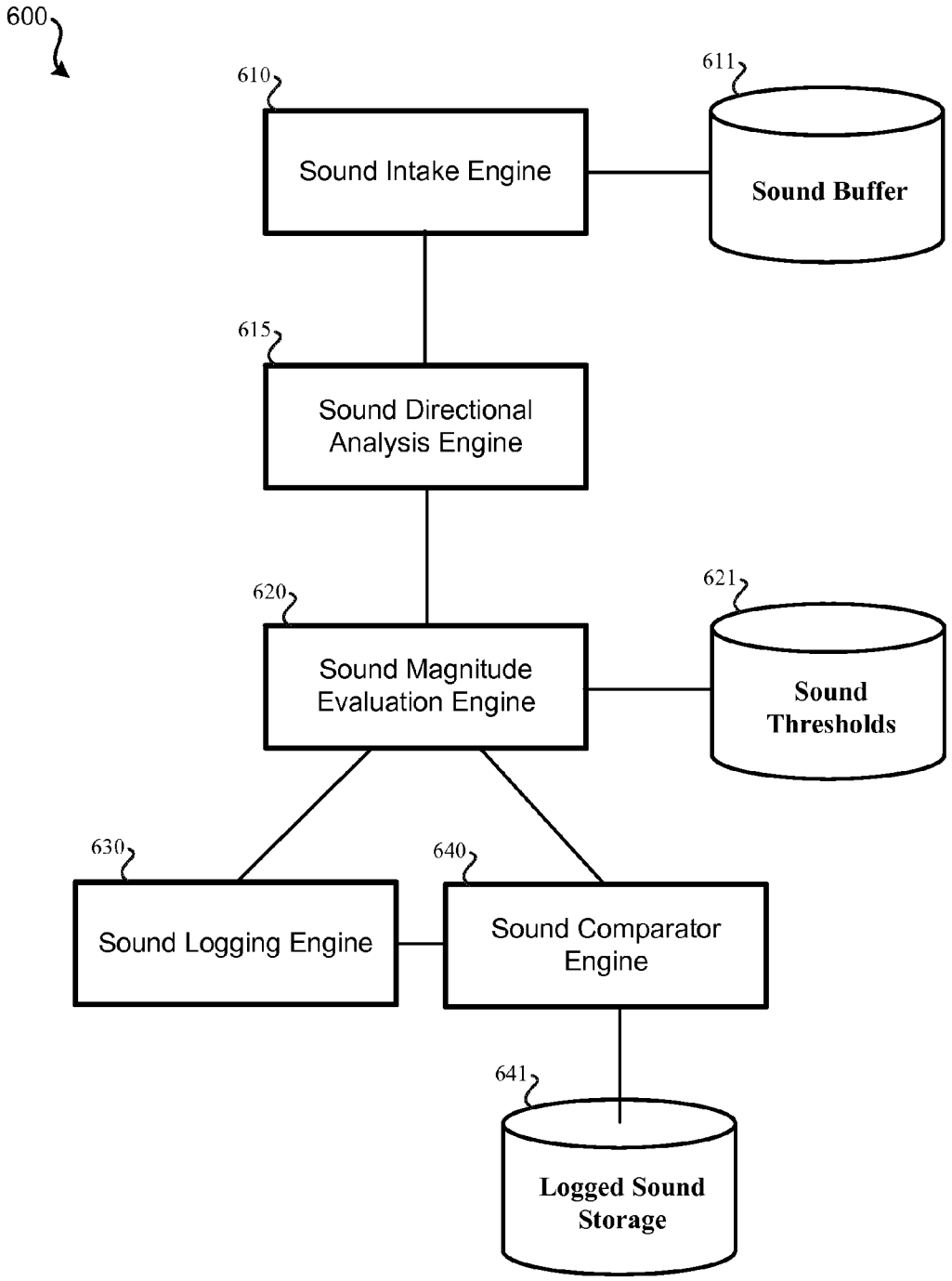
FIG. 6 illustrates an embodiment of a system for detecting and positioning sounds.

FIG. 6 illustrates an embodiment of a system 600 for detecting and positioning sounds. System 600 includes multiple components which can be implemented in the form of computerized hardware, firmware, and/or software executed by underlying computerized hardware. In some embodiments, system 600 is part of the home automation host system; in other embodiments, some or all of the components of system 600 are cloud based. That is, the functionality of such components may be performed by a remote server, such as a remote server of a television service provider that provides television services and/or home automation services to a television receiver and/or overlay device of the user. System 600 can include: sound intake engine 610, sound buffer 611, sound directional analysis engine 615, sound magnitude evaluation engine 620, sound threshold database 621, sound logging engine 630, sound comparator engine 640, and logged sound storage 641.

Sound intake engine 610 may serve to receive information about sounds from multiple home automation devices. (For the purposes of this description, it should be understood that the device containing system 600 can be considered a home automation device—that is, a home automation host system can also collect information about environmental sounds directly.) The information received by sound intake engine 610 from a home automation device about a sound may include: a timestamp, a measure of magnitude (e.g., decibel level), and/or a recording of the sound. At least temporarily, such information may be stored to sound buffer 611. Sound buffer 611 may be some form of non-transitory computer-readable medium, such as random access memory (RAM). Sound intake engine 610 may analyze received sound information from multiple home automation devices to determine if such sound information likely corresponds to the same sound. For instance, sound intake engine 610 may analyze the measured sound magnitude, the recordings, and/or the timestamps of such sound information to determine if sound information received from the multiple home automation devices likely corresponds to the same originating sound. Sound intake engine 610 may then classify different pieces of sound information as being attributed to the same sound.

Sound directional analysis engine 615 may use sound information that has been attributed to the same sound by sound intake engine 610 to determine a direction and/or location from which the sound originated. In some embodiments, sound directional analysis engine 615 may be able to more precisely place the direction or location of the sound depending on the number (e.g., 2, 3, 4, or more) of home automation devices that provided sound information corresponding to the sound. It may be more likely that sound directional analysis engine 615 can determine a general location within a structure at which a sound originated as compared to a location outside of the structure at which the sound originated. Sound directional analysis engine 615, possibly using a floor plan and/or arrangement of home automation devices that have been provided by a user or otherwise discovered, may determine whether the sound originated inside or outside of a structure. If sufficient information is available, a direction and/or location at which the sound occurred may be identified.

Sound magnitude evaluation engine 620 may evaluate how loud the sound was. Sound magnitude evaluation engine 620 may use the indications of sound magnitude received from the multiple home automation devices to determine a mean or median sound magnitude. In some embodiments, the maximum magnitude identified by the home automation device may be used as the magnitude for the sound as this home automation device was likely the closest home automation device to the origination location of the sound. In some embodiments, the magnitude may be extrapolated based on the measured magnitudes and the determined location or direction of the sound. Sound magnitude evaluation engine 620 may compare the determined sound magnitude against one or more sound thresholds stored in sound threshold database 621. Sound thresholds may be stored in sound threshold database 621. Sound threshold database 621 may be some form of non-transitory computer readable medium, such as random access memory (RAM). Depending on the location or direction, the time, the day of the week, and/or any other preference specified by a user, an appropriate sound threshold may be selected from sound threshold database 621 for comparison to the determined sound magnitude. If the threshold has exceeded the determined magnitude, information about the sound may be logged. If the threshold is not exceeded by the determined magnitude, information about the sound may be deleted.

Sound logging engine 630 may store information about the sound to a log. The log may contain information regarding the location/direction of the sound, the sound magnitude, a timestamp of the sound, and whether the sound is a recurring sound. To determine if the sound is recurring, sound comparator engine 640 may compare a sound that is determined to qualify for logging by sound magnitude evaluation engine 620 with other sounds that have been previously logged. Other sounds that have been previously logged may be stored by logged sound storage 641. Logged sound storage 641 may be some form of non-transitory computer-readable medium, such as RAM. Sound comparator engine 640 may determine two sounds have a common source if the sounds originate from a same general location/direction and/or the sounds have similar acoustic properties. As such, sound comparator engine 640 may compare recordings of the two sounds to determine if these sounds are likely being generated by the same source. This may be a form of threshold analysis; that is, sounds determined to be similar with the threshold amount may be identified as recurring sounds.

Figure 7:
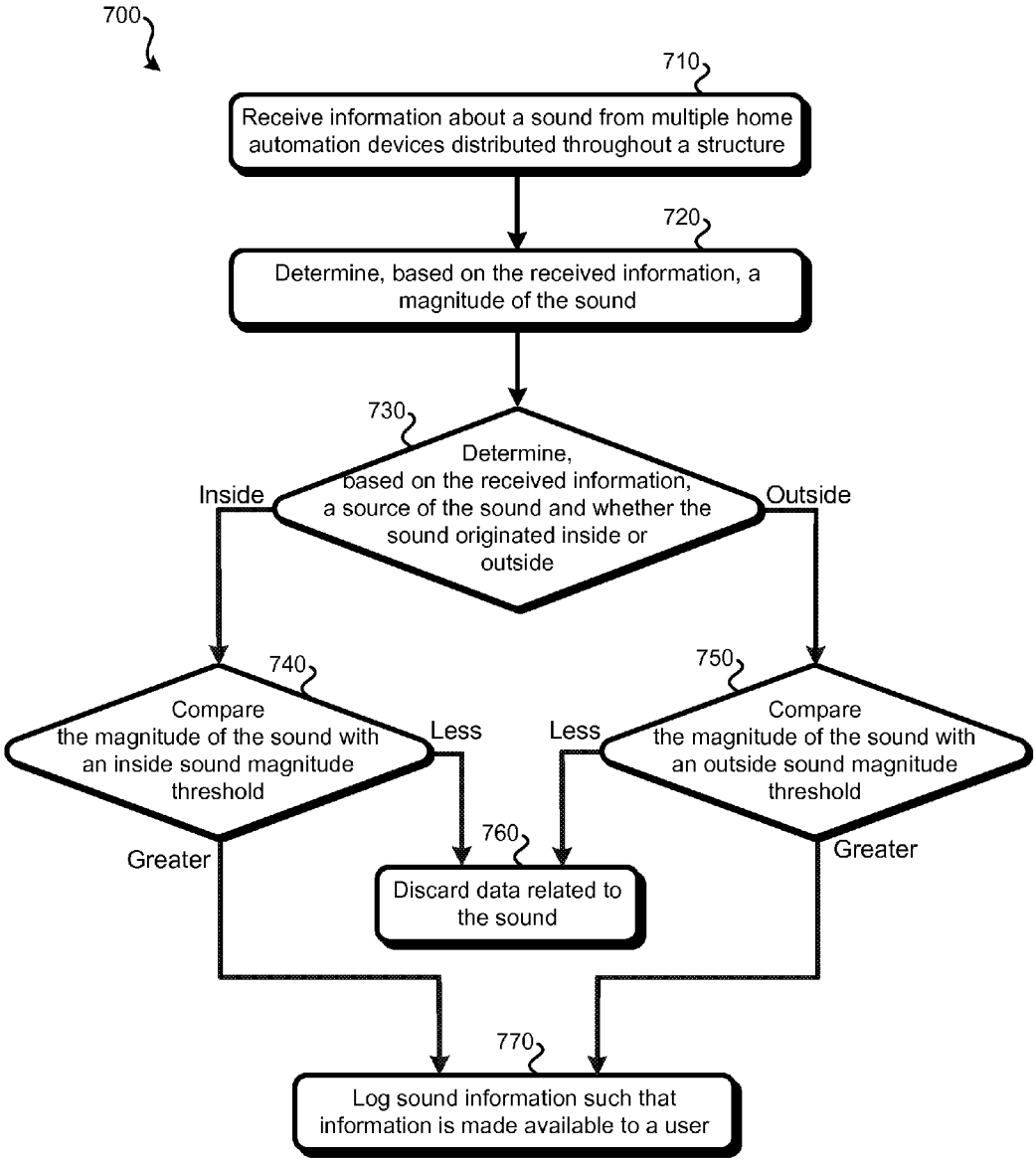
FIG. 7 illustrates an embodiment of a method for detecting and positioning sounds.

FIG. 7 illustrates an embodiment of a method 700 for detecting and positioning sounds. Method 700 may be performed by system 600, which may be executed by part of a home automation host system (e.g., home automation host system 230, television receiver 150) or some other system that performs home automation management functions. Each block of method 700 may be performed by a home automation host system, which is a specialized computerized device configured to perform home automation functions. More specifically, each block of method 700 may be performed by an overlay device (e.g., overlay device 151 of FIG. 1) that is configured to output home automation information to a display device (e.g., display device 160).

At block 710, information about a sound may be received from multiple home automation devices that are located in various locations in and/or outside a structure. The information about the sound may include a measured magnitude (e.g., decibel level), a time stamp of the sound, and/or a recording of the sound. The information about the sound may be transmitted by the home automation device because the sound exceeded a threshold level used by the home automation device to determine whether sound information should be recorded and/or transmitted to the home automation host system.

At block 720, based on the received sound information from one or more home automation devices, plus, possibly, information about the sound directly collected by the home automation host system, a magnitude of the sound may be determined. Various ways of determining the magnitude of the sound may be performed. For instance, a mean or median magnitude of the sound may be calculated based on each instance of sound information. The highest magnitude indicated in sound information may be used (because the home automation device that recorded the highest magnitude sound was likely the closest device to the origination location of the sound). In other embodiments, the magnitude of the sound may be extrapolated, based on an identified source location of the sound and the sound information.

At block 730, using the received sound information (and/or sound information determined by the home automation host system itself), a location or direction of from where the sound originated may be determined. In some embodiments, the location or direction is determined, using a time-of-flight analysis and/or by evaluating the relative magnitudes of the sound as measured by the home automation devices. The location or direction may indicate whether the sound likely originated inside or outside of the structure. If enough information is present to make a more detailed determination, a particular direction (if outside), location, or room (e.g., kitchen) may be determined.

If the sound is determined to originate inside, method 700 proceeds to block 740. At block 740, the magnitude of the sound is compared with an inside sound magnitude threshold to determine if the sound should be logged. The inside sound magnitude threshold may be defined by a user of the home automation host system or by the service provider of the home automation system. The user may define the magnitude based on whether the user is at home, at work, away on vacation, active in the home, asleep (e.g., by defining hours during the day when the user is typically sleeping), etc. For instance, geo-fencing may be used to adjust the inside sound magnitude threshold based on whether the user is present at the structure or elsewhere. A lower inside sound magnitude threshold may be set if the user is away from the structure. A higher threshold may be set if, for example, the user has a pet that will remain home while the user is gone. If the magnitude of the sound determined at block 720 meets or exceeds the inside sound magnitude threshold, method 700 proceeds to block 770. Otherwise, method 700 proceeds to block 760 and the sound information is discarded.

If the sound is determined to originate outside, method 700 proceeds to block 750. At block 750, the magnitude of the sound is compared with an outside sound magnitude threshold to determine if the sound should be logged. The outside sound magnitude threshold may be defined by a user of the home automation host system or by the service provider of the home automation system. Typically, the outside sound threshold may be set to a greater magnitude than the inside sound threshold. The user may define the magnitude based on whether the structure is near a busy street, construction, etc. Geo-fencing may be used to adjust the outside sound magnitude threshold based on whether the user is present at the structure or elsewhere. A lower or higher outside sound magnitude threshold may be set if the user is away from the structure. A higher threshold may be set if, for example, the user has a pet that will remain outside the home while the user is gone. If the magnitude of the sound determined at block 720 meets or exceeds the outside sound magnitude threshold, method 700 proceeds to block 770. Otherwise, method 700 proceeds to block 760 and the sound information is discarded.

At block 770, sound information may be logged such that the sound information is made available for review to the user at a later time. The logged sound information may indicate: a timestamp of the sound, a location or direction of the sound, an indication of whether the sound originated inside or outside, an indication of whether a recording of the sound is available for playback, and an indication of whether the sound is recurring. Information about recurrence is detailed in relation to method 800 of FIG. 8.

If a sound is to be logged, a recording of the sound may be requested from one or more of the home automation devices. The home automation device that recorded the highest magnitude volume of the sound may provide the recording of the sound to the home automation host system. This may be provided to the home automation host system upon request or by determination of the home automation device itself (e.g., based on a threshold analysis). In some embodiments, the home automation host system itself creates the recording.

In some embodiments, if a sound is logged, information about the sound may be sent to a user, such as to a mobile device of the user. For instance, a text message, which may include a link to a recording, may be sent to a user's mobile device. Similar information that is logged about the sound may be sent to the user's mobile device, such as a direction, magnitude, whether the sound is recurring, a timestamp, etc. In some embodiments, a user may specify that a sound must be determined to recur a defined number of times (e.g., set by the user) before information is sent to the user's mobile device.

Figure 8:
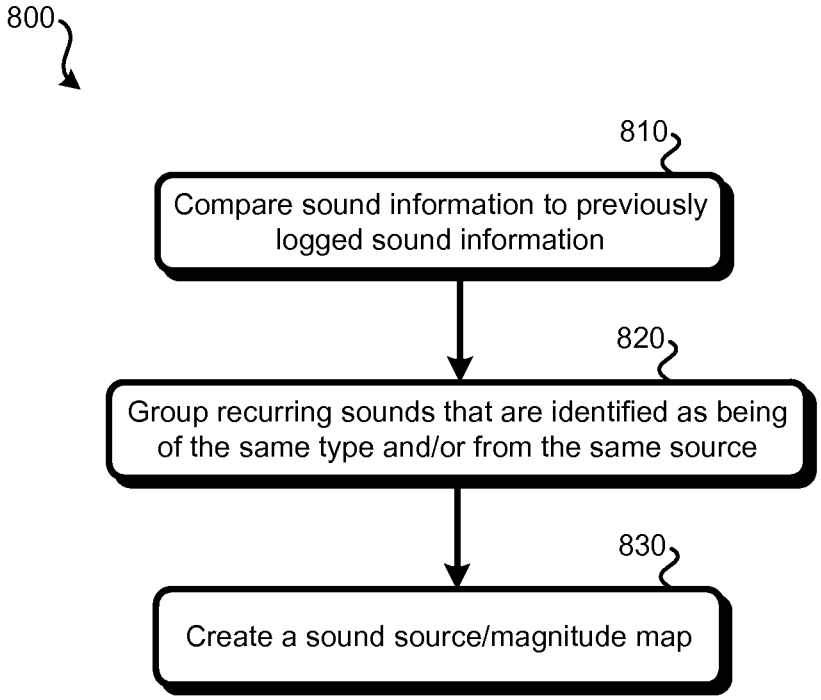
FIG. 8 illustrates another embodiment of a method for determining whether a sound is recurring.

FIG. 8 illustrates an embodiment of a method 800 for determining whether a sound is recurring. Method 800 may be performed by system 600, which may be executed by part of a home automation host system (e.g., home automation host system 230) or some other system that performs home automation management functions. Each block of method 800 may be performed by a home automation host system, which is a specialized computerized device configured to perform home automation functions. More specifically, each block of method 800 may be performed by an overlay device (e.g., overlay device 151 of FIG. 1) that is configured to output home automation information to a display device (e.g., display device 160).

For a sound determined to be logged (e.g., via method 700 of FIG. 7), it may be compared with the sound information, including a recording, of other, previously logged sounds at block 810. A sound may be determined to be recurring if it occurs in the same general location or originates from the same direction, is similar in magnitude, and/or available recordings of the sounds match (within a threshold amount).

At block 820, recorded sounds may be grouped and identified as recurring in an interface presented to a user. It may be determined the number of times the sound has recurred. For example, interface 500 of FIG. 5 may present a number of times that a particular sound has been determined to have recurred. These grouped sounds may be identified as originating from the same source and/or as being the same type of sound. At block 830, a sound source/sound magnitude map may be created that highlights for a user where logged sounds originate and/or where the loudest sounds originate. Therefore, by looking at the map, the user can identify the sources of logged sounds.

Figure 9:
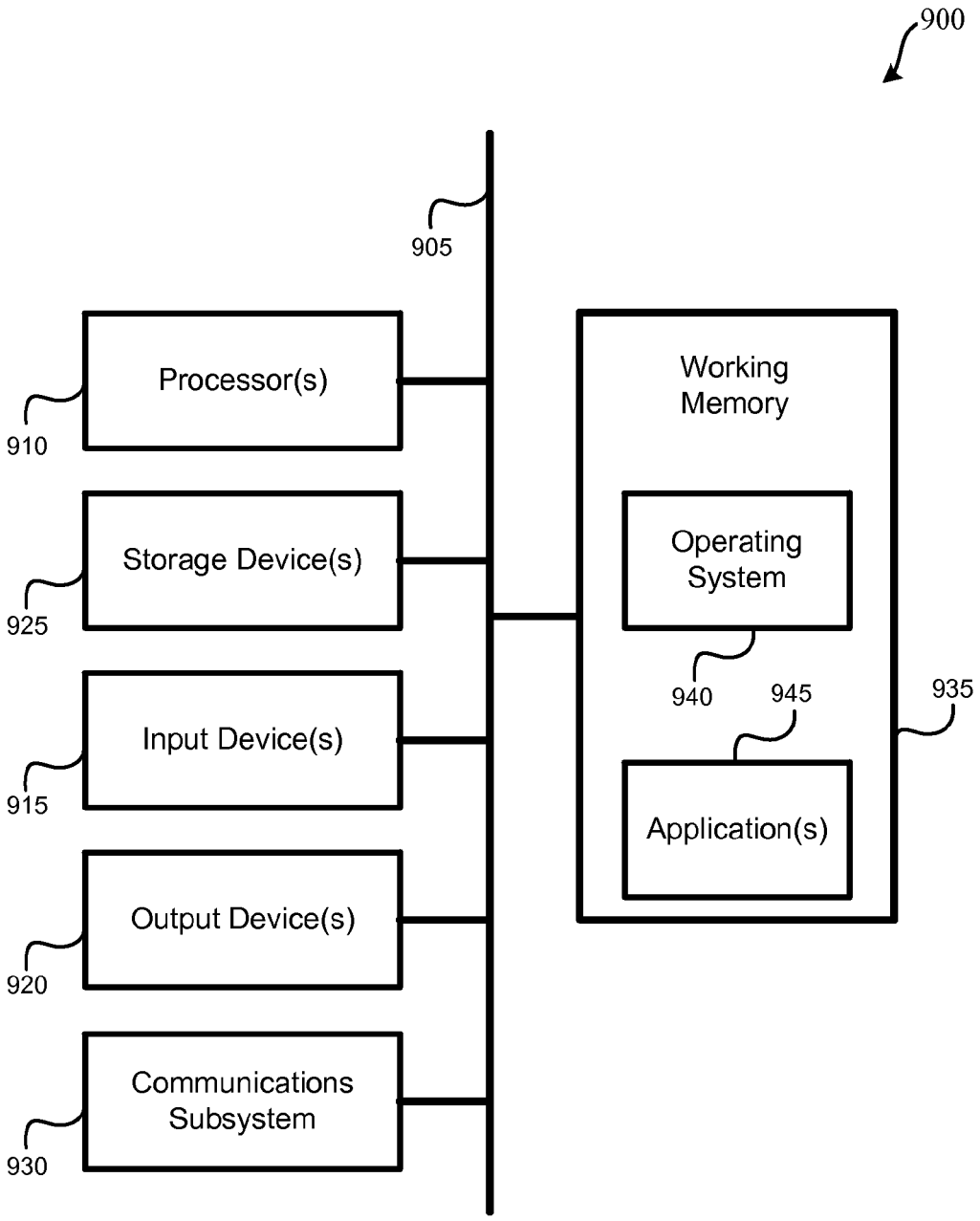
FIG. 9 illustrates an embodiment of a computer system.

FIG. 9 illustrates an embodiment of a computer system 900. A computer system as illustrated in FIG. 9 may be incorporated as part of the previously described computerized devices, such as a home automation host system and any of the home automation devices indicated in this document. The functionality of computer system 900 may be incorporated as part of various computerized devices that are specialized to perform particular home automation functions. As such, a home automation host system may have the functionality of computer system 900 and in addition have specialized hardware for performing home automation functions and presenting FIG. 9 provides a schematic illustration of one embodiment of a computer system 900 that can perform various blocks of the methods provided by various embodiments. It should be noted that FIG. 9 is meant only to provide a generalized illustration of various components, any or all of which may be utilized as appropriate. FIG. 9, therefore, broadly illustrates how individual system elements may be implemented in a relatively separated or relatively more integrated manner.

The computer system 900 is shown comprising hardware elements that can be electrically coupled via a bus 905 (or may otherwise be in communication, as appropriate). The hardware elements may include one or more processors 910, including without limitation one or more general-purpose processors and/or one or more special-purpose processors (such as digital signal processing chips, graphics acceleration processors, video decoders, and/or the like); one or more input devices 915, which can include without limitation a mouse, a keyboard, remote control, and/or the like; and one or more output devices 920, which can include without limitation a display device, a printer, and/or the like.

The computer system 900 may further include (and/or be in communication with) one or more non-transitory storage devices 925, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable and/or the like. Such storage devices may be configured to implement any appropriate data stores, including without limitation, various file systems, database structures, and/or the like.

The computer system 900 might also include a communications subsystem 930, which can include without limitation a modem, a network card (wireless or wired), an infrared communication device, a wireless communication device, and/or a chipset (such as a Bluetooth™ device, an 802.11 device, a WiFi device, a WiMax device, cellular communication device, etc.), and/or the like. The communications subsystem 930 may permit data to be exchanged with a network (such as the network described below, to name one example), other computer systems, and/or any other devices described herein. In many embodiments, the computer system 900 will further comprise a working memory 935, which can include a RAM or ROM device, as described above.

The computer system 900 also can comprise software elements, shown as being currently located within the working memory 935, including an operating system 940, device drivers, executable libraries, and/or other code, such as one or more application programs 945, which may comprise computer programs provided by various embodiments, and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be stored on a non-transitory computer-readable storage medium, such as the non-transitory storage device(s) 925 described above. In some cases, the storage medium might be incorporated within a computer system, such as computer system 900. In other embodiments, the storage medium might be separate from a computer system (e.g., a removable medium, such as a compact disc), and/or provided in an installation package, such that the storage medium can be used to program, configure, and/or adapt a general purpose computer with the instructions/code stored thereon. These instructions might take the form of executable code, which is executable by the computer system 900 and/or might take the form of source and/or installable code, which, upon compilation and/or installation on the computer system 900 (e.g., using any of a variety of generally available compilers, installation programs, compression/decompression utilities, etc.), then takes the form of executable code.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer system (such as the computer system 900) to perform methods in accordance with various embodiments of the invention. According to a set of embodiments, some or all of the procedures of such methods are performed by the computer system 900 in response to processor 910 executing one or more sequences of one or more instructions (which might be incorporated into the operating system 940 and/or other code, such as an application program 945) contained in the working memory 935. Such instructions may be read into the working memory 935 from another computer-readable medium, such as one or more of the non-transitory storage device(s) 925. Merely by way of example, execution of the sequences of instructions contained in the working memory 935 might cause the processor(s) 910 to perform one or more procedures of the methods described herein.

The terms "machine-readable medium," "computer-readable storage medium" and "computer-readable medium," as used herein, refer to any medium that participates in providing data that causes a machine to operate in a specific fashion. These mediums may be non-transitory. In an embodiment implemented using the computer system 900, various computer-readable media might be involved in providing instructions/code to processor(s) 910 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the non-transitory storage device(s) 925. Volatile media include, without limitation, dynamic memory, such as the working memory 935.

Common forms of physical and/or tangible computer-readable media include, for example, a floppy disk, a flexible disk, hard disk, magnetic tape, or any other magnetic medium, a CD-ROM, any other optical medium, any other physical medium with patterns of marks, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 910 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 900.

The communications subsystem 930 (and/or components thereof) generally will receive signals, and the bus 905 then might carry the signals (and/or the data, instructions, etc. carried by the signals) to the working memory 935, from which the processor(s) 910 retrieves and executes the instructions. The instructions received by the working memory 935 may optionally be stored on a non-transitory storage device 925 either before or after execution by the processor(s) 910.

It should further be understood that the components of computer system 900 can be distributed across a network. For example, some processing may be performed in one location using a first processor while other processing may be performed by another processor remote from the first processor. Other components of computer system 900 may be similarly distributed. As such, computer system 900 may be interpreted as a distributed computing system that performs processing in multiple locations. In some instances, computer system 900 may be interpreted as a single computing device, such as a distinct laptop, desktop computer, or the like, depending on the context.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps or blocks not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of blocks or steps may be undertaken before, during, or after the above elements are considered.

What is claimed is:

1. A method for detecting and positioning sound in a home automation system installed at a structure, the method comprising:

receiving, from a first home automation device by a home automation host system, a first indication of a sound and a first timestamp, wherein the first indication is indicative of a first measured sound magnitude and the first home automation device is located within the structure;

receiving, from a second home automation device by the home automation host system, a second indication of the sound and a second timestamp, wherein the second indication is indicative of a second measured sound magnitude and the second home automation device is located outside the structure;

receiving, from a third home automation device by the home automation host system, a third indication of the sound and a third timestamp, wherein the third indication is indicative of a third measured sound magnitude;

determining, by the home automation host system, using the first indication, the second indication, the third indication, the first timestamp, the second timestamp, and the third timestamp, a location of the sound, a sound magnitude for the sound and whether the sound originated inside or outside of the structure, wherein:

the sound magnitude is extrapolated based on the determined location of the sound; and at least one home automation device of the first home automation device, the second home automation device, and the third home automation device is located within the structure;

comparing, by the home automation host system, the sound magnitude to an inside sound threshold level if the sound was determined to originate inside the structure or comparing, by the home automation host system, the sound magnitude to an outside sound threshold level if the sound was determined to originate outside the structure; and logging, by the home automation host system, sound information corresponding to the sound if: the sound was determined to originate inside and the sound magnitude exceeds the inside sound threshold level; or the sound was determined to originate outside and the sound magnitude exceeds the outside sound threshold level.

2. The method for detecting and positioning sound in the home automation system installed at the structure of claim 1, the method further comprising:

transmitting, to a user mobile device from the home automation host system, a notification of the sound if the sound was determined to originate inside and the sound magnitude exceeds the inside sound threshold level, or the sound was determined to originate outside and the sound magnitude exceeds the outside sound threshold level, the outside sound threshold level being greater than the inside sound threshold level.

3. The method for detecting and positioning sound in the home automation system installed at the structure of claim 1, wherein at least one of the first indication, the second indication, and the third indication comprises a recording of the sound, the method further comprising:

storing, by the home automation host system, the recording of the sound if the sound was determined to originate inside and the sound magnitude exceeds the inside sound threshold level, or the sound was determined to originate outside and the sound magnitude exceeds the outside sound threshold level.

4. The method for detecting and positioning sound in the home automation system installed at the structure of claim 1, wherein determining whether the sound originated inside or outside of the structure comprises: determining, by the home automation host system, a direction from which the sound originated.

5. The method for detecting and positioning sound in the home automation system installed at the structure of claim 3, further comprising:

comparing, by the home automation host system, the recording of the sound to one or more stored recordings of sounds previously logged;

determining, by the home automation host system, the recording of the sound matches the one or more stored recordings of sounds previously logged; and storing, by the home automation host system, an indication of a recurring sound based on the recording of the sound being determined to match the one or more stored recordings of sounds previously logged.

6. The method for detecting and positioning sound in the home automation system installed at the structure of claim 5, further comprising:

outputting, by the home automation host system, via a display device, an interface that presents entries corresponding to logged sound information.

7. The method for detecting and positioning sound in the home automation system installed at the structure of claim 6, wherein the interface, for the logged sound information, indicates: a direction from which the sound originated; an indication of whether the sound originated inside or outside of the structure; and an option to playback the recording of the sound.

8. The method for detecting and positioning sound in the home automation system installed at the structure of claim 7, wherein the interface, for the logged sound information, further indicates: a number of times sounds similar to the logged sound information has been logged.

9. The method for detecting and positioning sound in the home automation system installed at the structure of claim 7, wherein determining, by the home automation host system, using the first indication, the second indication, and the third indication, whether the sound originated inside or outside of the structure, comprises performing, by the home automation host system, a time-of-flight analysis using the first timestamp, the second timestamp, and the third timestamp.

10. The method for detecting and positioning sound in the home automation system installed at the structure of claim 1, wherein the first home automation device is located on an exterior of the structure and the second home automation device and the third home automation device are located inside the structure.

11. The method for detecting and positioning sound in the home automation system installed at the structure of claim 1, wherein the first home automation device, the second home automation device, and the third home automation device have a primary purpose other than collecting sound for identifying environmental sound sources.

12. A home automation system for detecting and positioning sound at a structure, the home automation system comprising:

a first home automation device, located within the structure;

a second home automation device, located outside the structure; and a home automation host device, configured to:

receive, from the first home automation device, a first indication of a sound and a first timestamp, wherein the first indication is indicative of a first measured sound magnitude;

receive, from the second home automation device, a second indication of the sound and a second timestamp, wherein the second indication is indicative of a second measured sound magnitude;

determine, using the first indication, the second indication, the first timestamp, and the second timestamp, a location of the sound, a sound magnitude for the sound and whether the sound originated inside or outside of the structure, wherein the sound magnitude is extrapolated based on the determined location of the sound;

compare the sound magnitude to an inside sound threshold level if the sound was determined to originate inside the structure or compare the sound magnitude to an outside sound threshold level if the sound was determined to originate outside the structure; and log sound information corresponding to the sound if: the sound was determined to originate inside and the sound magnitude exceeds the inside sound threshold level; or the sound was determined to originate outside and the sound magnitude exceeds the outside sound threshold level.

13. The home automation system for detecting and positioning sound at the structure of claim 12, wherein the home automation host device further configured to:

transmit, to a user mobile device, a notification of the sound if the sound was determined to originate inside and the sound magnitude exceeds the inside sound threshold level, or the sound was determined to originate outside and the sound magnitude exceeds the outside sound threshold level, the outside sound threshold level being greater than the inside sound threshold level.

14. The home automation system for detecting and positioning sound at the structure of claim 12, wherein at least one of the first indication and the second indication comprises a recording of the sound, the home automation host device further configured to:

store the recording of the sound if the sound was determined to originate inside and the sound magnitude exceeds the inside sound threshold level, or the sound was determined to originate outside and the sound magnitude exceeds the outside sound threshold level.

15. The home automation system for detecting and positioning sound at the structure of claim 12, wherein the home automation host device determining whether the sound originated inside or outside of the structure comprises the home automation host device being configured to determine a direction from which the sound originated.

16. The home automation system for detecting and positioning sound at the structure of claim 14, wherein the home automation host device is further configured to:

compare the recording of the sound to one or more stored recordings of sounds previously logged;

determine the recording of the sound matches the one or more stored recordings of sounds previously logged; and store an indication of a recurring sound based on the recording of the sound being determined to match the one or more stored recordings of sounds previously logged.

17. The home automation system for detecting and positioning sound at the structure of claim 16, wherein the home automation host device is further configured to:

output, to a display device, an interface that presents entries corresponding to logged sound information.

18. The home automation system for detecting and positioning sound at the structure of claim 17, wherein the interface output to the display device by the home automation host device indicates: a direction from which the sound originated; an indication of whether the sound originated inside or outside of the structure; and an option to playback the recording of the sound.

19. The home automation system for detecting and positioning sound at the structure of claim 17, wherein the interface output to the display device by the home automation host device indicates: a number of times sounds similar to the logged sound information has been logged.

20. A non-transitory processor-readable medium, comprising processor-readable instructions configured to cause one or more processors to:

receive, from a first home automation device, a first indication of a sound and a first timestamp, wherein the first indication is indicative of a first measured sound magnitude and the first home automation device is located within a structure;

receive, from a second home automation device, a second indication of the sound and a second timestamp, wherein the second indication is indicative of a second measured sound magnitude and the second home automation device is located outside the structure;

receive, from a third home automation device, a third indication of the sound and a third timestamp, wherein the third indication is indicative of a third measured sound magnitude;

determine, using the first indication, the second indication, the third indication, the first timestamp, the second timestamp, and the third timestamp, a location of the sound, a sound magnitude for the sound, and whether the sound originated inside or outside of the structure, wherein the sound magnitude is extrapolated based on the determined location of the sound;

compare the sound magnitude to an inside sound threshold level if the sound was determined to originate inside the structure or compare the sound magnitude to an outside sound threshold level if the sound was determined to originate outside the structure; and log sound information corresponding to the sound if: the sound was determined to originate inside and the sound magnitude exceeds the inside sound threshold level; or the sound was determined to originate outside and the sound magnitude exceeds the outside sound threshold level.

* * * * *